US012502044B2

(12) United States Patent
Turner et al.

(10) Patent No.: US 12,502,044 B2
(45) Date of Patent: Dec. 23, 2025

(54) VACUUM ATTACHMENT AND MANUAL BRUSH FOR REMOVING HAIR AND/OR FIBROUS DEBRIS

(71) Applicants: Stephen S. Turner, Edelstein, IL (US); Scott I. Turner, Chillicothe, IL (US)

(72) Inventors: Stephen S. Turner, Edelstein, IL (US); Scott I. Turner, Chillicothe, IL (US)

( * ) Notice: Subject to any disclaimer, the term of this patent is extended or adjusted under 35 U.S.C. 154(b) by 341 days.

(21) Appl. No.: 18/131,087

(22) Filed: Apr. 5, 2023

(65) Prior Publication Data

US 2023/0309769 A1 Oct. 5, 2023

Related U.S. Application Data

(60) Provisional application No. 63/327,778, filed on Apr. 5, 2022.

(51) Int. Cl.
*A47L 9/06* (2006.01)

(52) U.S. Cl.
CPC ..... *A47L 9/0613* (2013.01); *A47L 9/062* (2013.01); *A47L 9/0693* (2013.01)

(58) Field of Classification Search
CPC ..... A47L 9/0613; A47L 9/062; A47L 9/0693; A47L 9/06; A47L 9/0606; A47L 9/0673; A47L 9/068; A47L 11/4036
See application file for complete search history.

(56) References Cited

U.S. PATENT DOCUMENTS 566,110 A 8/1896 Wrigley
984,473 A 2/1911 Cornelius
1,051,992 A 2/1913 Fisher et al.
1,588,737 A 6/1926 Hurd
1,783,256 A 12/1930 Miller
2,659,924 A * 11/1953 Forsberg ..... A47L 9/0673 15/400
4,174,548 A 11/1979 Dunn
5,231,738 A 8/1993 Higashinaka
5,319,821 A * 6/1994 Nicholson ..... A46B 15/0053 15/144.3

(Continued)

FOREIGN PATENT DOCUMENTS

CN 2490219 Y 5/2002
FR 3009007 A1 1/2015
WO 2013048088 A1 4/2013

*Primary Examiner* — Shay Karls
(74) *Attorney, Agent, or Firm* — The Law Office of Patrick F. O'Reilly III, LLC

(57) ABSTRACT

A vacuum attachment for removing hair and/or fibrous debris from a crevice or surface being cleaned is disclosed herein. The vacuum attachment includes an attachment body portion, a first end of the attachment body portion configured to be connected to a vacuum hose, and the attachment body portion defining an air intake aperture at a second end of the attachment body portion; and an elongated rod disposed across a portion of the air intake aperture at the second end of the attachment body portion, the elongated rod including a plurality of protruding elements projecting outwardly from the elongated rod, the plurality of protruding elements being disposed at least partially around a periphery of the elongated rod and along at least a portion of a length of the elongated rod between the first end and the second end. A manual brush for removing hair and/or fibrous debris is also disclosed herein.

20 Claims, 19 Drawing Sheets

(56) References Cited

U.S. PATENT DOCUMENTS

| | | | | |
|---|---|---|---|---|
| 5,423,621 | A | 6/1995 | Russell | |
| 5,769,960 | A | 6/1998 | Nirmel | |
| 5,836,032 | A | 11/1998 | Hondo | |
| 6,131,229 | A | 10/2000 | Lincuna et al. | |
| 6,775,873 | B2 | 8/2004 | Luoma | |
| 6,827,794 | B2 | 12/2004 | Sommerfeld, Sr. | |
| 6,898,807 | B2 | 5/2005 | Tash | |
| 7,584,513 | B2 | 9/2009 | Turner | |
| 7,810,176 | B2 | 10/2010 | Turner | |
| 8,205,296 | B1 * | 6/2012 | Bissell | A47L 9/04 15/421 |
| 8,359,696 | B1 | 1/2013 | Turner et al. | |
| 8,745,771 | B2 | 6/2014 | Bates et al. | |
| 9,670,656 | B2 | 6/2017 | Rutkowski | |
| 9,945,108 | B1 * | 4/2018 | Turner | B08B 9/045 |
| 10,047,508 | B2 | 8/2018 | Elliott et al. | |
| 10,072,405 | B2 | 9/2018 | Beck et al. | |
| 10,683,648 | B2 | 6/2020 | Beck et al. | |
| 10,857,577 | B2 | 12/2020 | Turner et al. | |
| 11,898,338 | B2 | 2/2024 | Turner et al. | |
| 12,209,400 | B2 * | 1/2025 | Turner | E03C 1/306 |
| 2006/0021123 | A1 | 2/2006 | Turner | |
| 2006/0195994 | A1 | 9/2006 | Hung | |
| 2012/0005849 | A1 | 1/2012 | Tash | |
| 2013/0000680 | A1 | 1/2013 | Azelton et al. | |
| 2016/0221050 | A1 | 8/2016 | Beck et al. | |
| 2016/0331199 | A1 * | 11/2016 | Peng | A47L 9/242 |
| 2021/0086240 | A1 | 3/2021 | Turner et al. | |
| 2022/0112703 | A1 | 4/2022 | Turner et al. | |

* cited by examiner

Section A-A

Section B-B

Example vacuum adapter assembly instruction

60

Detail "A"

Detail "A" Alternative

SECTION C-C

SECTION D-D

VACUUM ATTACHMENT AND MANUAL BRUSH FOR REMOVING HAIR AND/OR FIBROUS DEBRIS

CROSS-REFERENCE TO RELATED APPLICATIONS

This patent application claims priority to, and incorporates by reference in its entirety, U.S. Provisional Patent Application No. 63/327,778, entitled "Vacuum Attachment And Manual Brush For Removing Hair And/Or Fibrous Debris", filed on Apr. 5, 2022.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a vacuum attachment and manual brush for removing hair and/or fibrous debris. More particularly, the invention relates to a vacuum attachment and manual brush with a bent elongated rod with protruding elements for removing hair and/or fibrous debris from a crevice and/or surface.

2. Background

Cleaning pet hair and similar fibrous debris from carpets and furniture is a significant effort for households everywhere. Vacuum cleaners alone or vacuums with brush-type attachments have been the standard solution for this common problem, but these solutions are time consuming, requiring a lot of effort going back and forth over the surface to try to dislodge the hair from the carpet/upholstery fibers. Automobile carpets and mats often have a more "wiry" texture and are notorious for grabbing and holding pet hair, making it difficult and time consuming trying to dislodge it with vacuum air only.

The standard straight bristle brushes that are typically included with vacuum brush attachments have trouble pulling the hair follicles away from the wiry carpet weave because the carpet fibers lay in random or curled fashion and the pet hair becomes embedded in these curvy carpet fibers which are "holding" the hair with more force than that provided by the sweep of a straight bristle nylon or rubber brush or the suction force of vacuum air only without a brush.

Therefore, what is needed is a vacuum attachment and manual brush for faster and more thorough cleaning of hair and fibrous matter from carpets, car mats, and similar surfaces.

BRIEF SUMMARY OF EMBODIMENTS OF THE INVENTION

Accordingly, the present invention is directed to a vacuum attachment and manual brush for removing hair and/or fibrous debris that substantially obviates one or more problems resulting from the limitations and deficiencies of the related art.

In accordance with one or more embodiments of the present invention, there is provided a vacuum attachment for removing hair and/or fibrous debris from a crevice or surface being cleaned. The vacuum attachment includes an attachment body portion, the attachment body portion having a first end and a second end, the first end of the attachment body portion being oppositely disposed relative to the second end of the attachment body portion, the first end of the attachment body portion configured to be connected to a vacuum hose, and the attachment body portion defining an air intake aperture at the second end of the attachment body portion; and an elongated rod disposed across a portion of the air intake aperture at the second end of the attachment body portion, the elongated rod having a first end and a second end, the first end of the elongated rod being oppositely disposed relative to the second end of the elongated rod, the elongated rod including a plurality of protruding elements projecting outwardly from the elongated rod, the plurality of protruding elements being disposed at least partially around a periphery of the elongated rod and along at least a portion of a length of the elongated rod between the first end and the second end. In these one or more embodiments, the plurality of protruding elements of the elongated rod are configured to grab and collect the hair and/or fibrous debris from the crevice or surface being cleaned by the vacuum attachment.

In a further embodiment of the present invention, the vacuum hose is fluidly coupled to a vacuum source configured to generate a suction force through the air intake aperture of the attachment body portion, and the vacuum attachment is configured to remove particulate debris from the crevice or surface being cleaned by means of the suction force, while simultaneously grabbing and collecting the hair and/or fibrous debris on the protruding elements of the elongated rod.

In yet a further embodiment, the attachment body portion comprises a first channel disposed on a first side of the attachment body portion and a second channel disposed on a second side of the attachment body portion, the first side being oppositely disposed relative to the second side; and the elongated rod is arranged in a bent configuration across the portion of the air intake aperture of the attachment body portion, the first end of the elongated rod being received within the first channel on the first side of the attachment body portion, and the second end of the elongated rod being received within the second channel on the second side of the attachment body portion.

In still a further embodiment, the bent configuration of the elongated rod is a substantially U-shaped configuration.

In yet a further embodiment, at least one of the first channel and the second channel comprises a plurality of staggered protrusions disposed therein, the plurality of staggered protrusions defining a passageway with staggered offset portions for securely retaining the elongated rod in place within the at least one of the first channel and the second channel of the attachment body portion.

In still a further embodiment, the elongated rod is removably coupled to the attachment body portion so that the elongated rod is able to be replaced with a new elongated rod after being used to remove the hair and/or fibrous debris from the crevice or surface.

In yet a further embodiment, the elongated rod further comprises a central core portion and an outer covering bonded to the central core portion, the outer covering formed from a hook material strip, the hook material strip comprising the plurality of protruding elements of the elongated rod, and the hook material strip being made from a hook side of a hook-and-loop fastener material.

In still a further embodiment, the central core portion is formed from a semi-flexible cable, the semi-flexible cable comprising a plurality of inner wires surrounded by an outer sheathing, the hook material strip being bonded to the outer sheathing of the semi-flexible cable.

In yet a further embodiment, the central core portion is formed from a plastic core.

In still a further embodiment, the plurality of protruding elements of the elongated rod are in the form of a plurality of injection-molded micro-hook elements.

In yet a further embodiment, the vacuum attachment is in a form of a vacuum crevice tool for vacuuming particulate debris from a crack or crevice.

In still a further embodiment, the vacuum attachment further comprises at least one insert adapter configured to be inserted into the first end of the attachment body portion so as to enable the vacuum attachment to accommodate a vacuum hose size with a connection diameter that is different than an opening diameter at the first end of the attachment body portion.

In yet a further embodiment, the at least one insert adapter configured to be inserted into the first end of the attachment body portion comprises a plurality of insert adapters having different sizes so as to accommodate vacuum hose sizes with different connection diameters.

In still a further embodiment, the vacuum attachment further comprises at least one elastic sleeve member configured to operate as a spacer between a first end opening of the attachment body portion and a connection end portion of the vacuum hose so as to enable the vacuum attachment to accommodate a vacuum hose size with a connection diameter that is smaller than the first end opening of the attachment body portion.

In yet a further embodiment, the at least one elastic sleeve member comprises a plurality of elastic sleeve members that useable together so as to accommodate vacuum hose sizes with different connection diameters.

In accordance with one or more other embodiments of the present invention, there is provided a manual brush for removing hair and/or fibrous debris from a crevice or surface being cleaned. The manual brush including a handle portion, the handle portion having a first end and a second end, the first end of the handle portion being oppositely disposed relative to the second end of the handle portion, the first end of the handle portion configured to be grasped by a user; and an elongated rod attached to the second end of the handle portion, the elongated rod having a first end and a second end, the first end of the elongated rod being oppositely disposed relative to the second end of the elongated rod, the elongated rod including a plurality of protruding elements projecting outwardly from the elongated rod, the plurality of protruding elements being disposed at least partially around a periphery of the elongated rod and along at least a portion of a length of the elongated rod between the first end and the second end. In these one or more other embodiments, the plurality of protruding elements of the elongated rod are configured to grab and collect the hair and/or fibrous debris from the crevice or surface being cleaned by the manual brush.

In a further embodiment of the present invention, the handle portion comprises a first attachment member disposed on a first side of the handle portion and a second attachment member disposed on a second side of the handle portion, the first side being oppositely disposed relative to the second side; and the elongated rod is arranged in a bent configuration on the second end of the handle portion, the first end of the elongated rod engaging with the first attachment member on the first side of the handle portion, and the second end of the elongated rod engaging with the second attachment member on the second side of the handle portion.

In yet a further embodiment, the elongated rod is removably coupled to the handle portion so that the elongated rod is able to be replaced with a new elongated rod after being used to remove the hair and/or fibrous debris from the crevice or surface.

In still a further embodiment, the elongated rod further comprises a central core portion and an outer covering bonded to the central core portion, the outer covering formed from a hook material strip, the hook material strip comprising the plurality of protruding elements of the elongated rod, and the hook material strip being made from a hook side of a hook-and-loop fastener material.

In yet a further embodiment, the manual brush further comprises a brush holder having a first side and a second side, the first side of the brush holder being oppositely disposed relative to the second side of the brush holder, the handle portion of the manual brush configured to be removably coupled to the first side of the brush holder, and the second side of the brush holder comprising a cleaning section with a plurality of protruding elements for cleaning the elongated rod of the manual brush.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
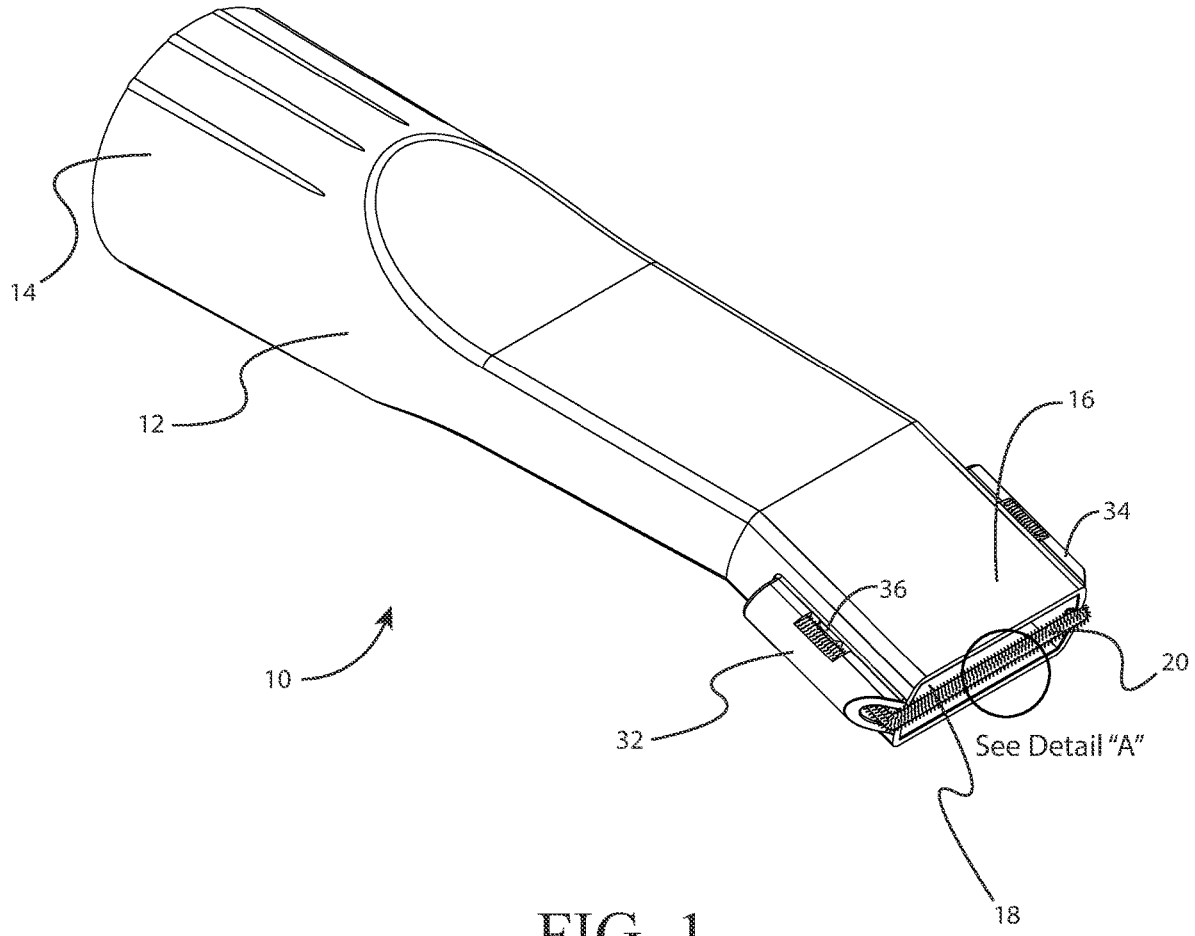
FIG. 1 is a perspective view of a vacuum attachment, according to a first illustrative embodiment of the invention, wherein the vacuum attachment includes an elongated rod with protruding elements disposed across a portion of an air intake aperture of the vacuum attachment.

An illustrative embodiment of a vacuum attachment is seen generally at 10 in FIGS. 1-9 and 11. The vacuum attachment 10 is used for removing hair and/or fibrous debris from a crevice or surface being cleaned. With initial reference to FIGS. 1, 8, and 11, it can be seen that the vacuum attachment 10 generally comprises an attachment body portion 12, the attachment body portion 12 having a first end 14 (i.e., the proximal end 14) and a second end 16 (i.e., the distal end 16), the first end 14 of the attachment body portion 12 being oppositely disposed relative to the second end 14 of the attachment body portion 12, the first end 14 of the attachment body portion 12 configured to be connected to a vacuum hose 44 (see e.g., FIG. 11), and the attachment body portion 12 defining an air intake aperture 18 at the second end 16 of the attachment body portion 12; and an elongated rod 20 disposed across a portion of the air intake aperture 18 at the second end 16 of the attachment body portion 12, the elongated rod 20 having a first end 24 and a second end 26, the first end 24 of the elongated rod 20 being oppositely disposed relative to the second end 26 of the elongated rod 20, the elongated rod 20 including a plurality of protruding elements 22 projecting outwardly from the elongated rod 20, the plurality of protruding elements 22 being disposed around a periphery of the elongated rod 20 and along at least a portion of a length of the elongated rod 20 between the first end 24 and the second end 26. In the illustrative embodiment, the plurality of protruding elements 22 of the elongated rod 20 are configured to grab and collect the hair and/or fibrous debris from the crevice or surface being cleaned by the vacuum attachment 10 (see e.g., FIG. 11).

In the illustrative embodiment, the vacuum hose 44 is fluidly coupled to a vacuum source (i.e., a vacuum cleaner) configured to generate a suction force through the air intake aperture 18 of the attachment body portion 12, and the vacuum attachment 10 is configured to remove particulate debris from the crevice or surface being cleaned by means of the suction force (see e.g., FIG. 11), while simultaneously grabbing and collecting the hair and/or fibrous debris on the protruding elements 22 of the elongated rod 20. In the illustrative embodiment, the vacuum attachment 10 is in a form of a vacuum crevice tool with a narrow air intake aperture 18 for vacuuming particulate debris from a crack or crevice.

Figure 2:
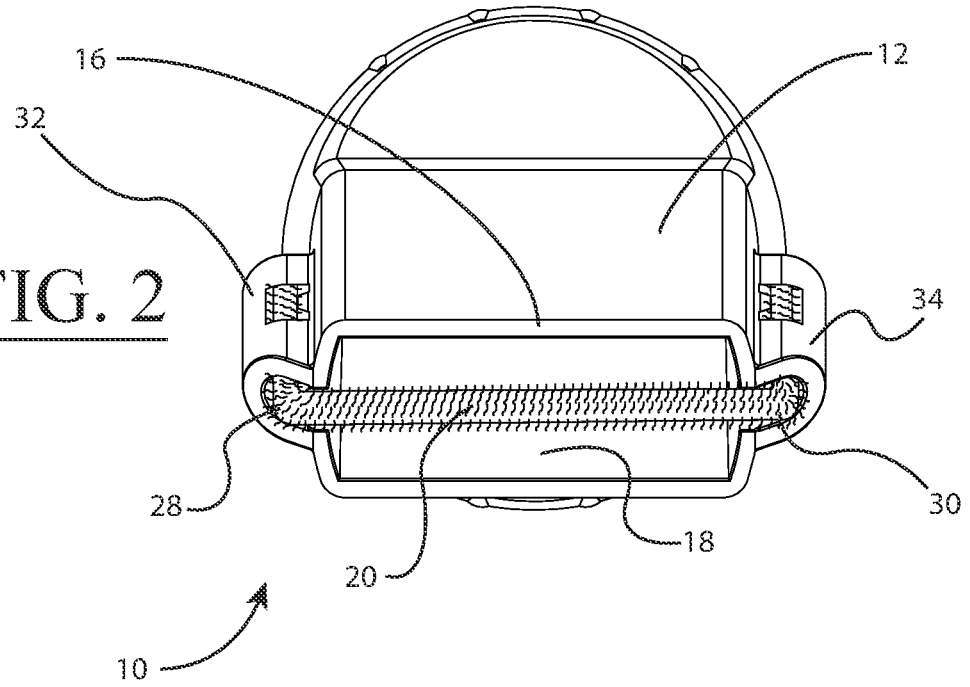
FIG. 2 is a distal end view of the vacuum attachment of FIG. 1.
Figure 8:
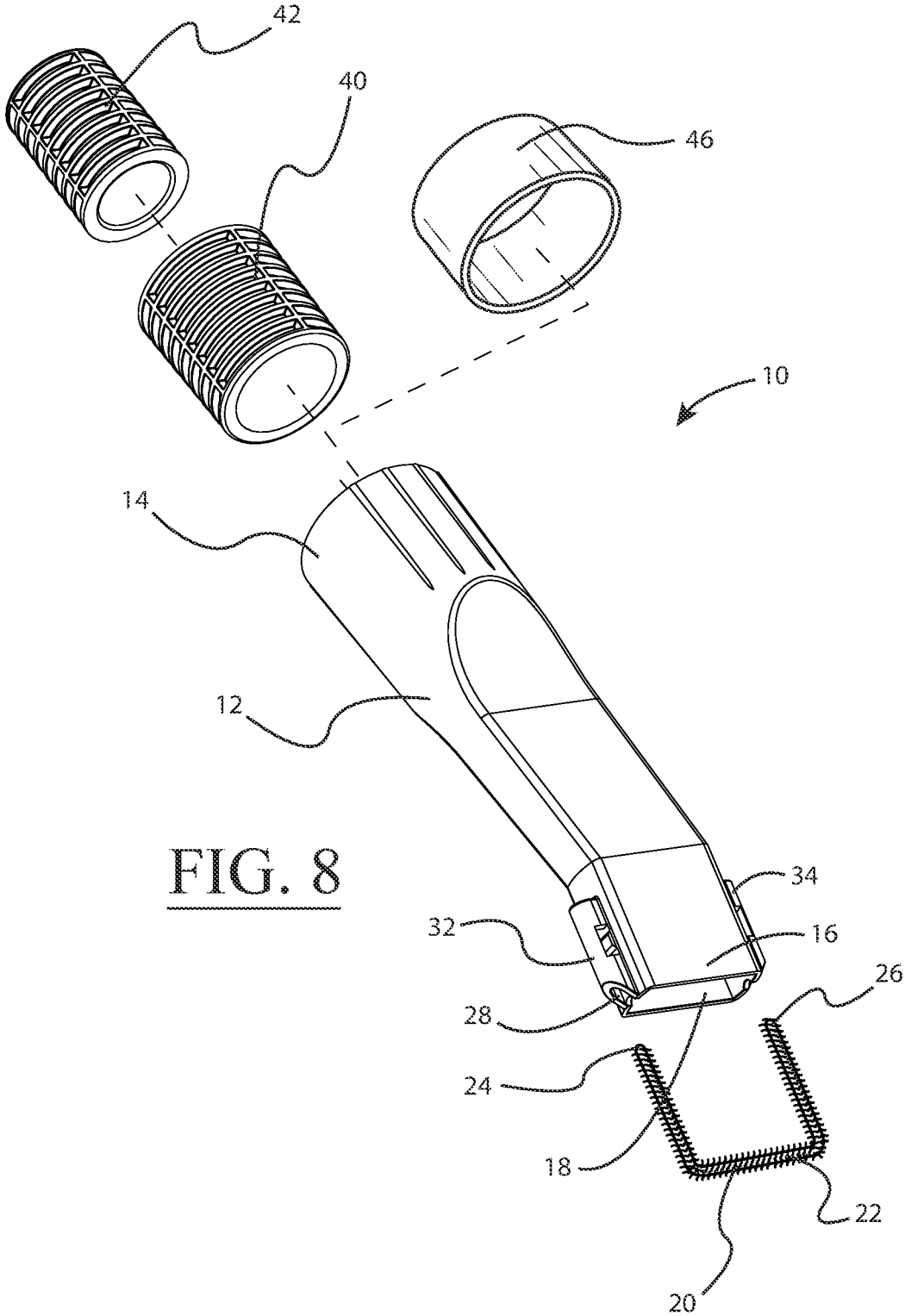
FIG. 8 is an exploded perspective view of the vacuum attachment of FIG. 1.
Figure 9:
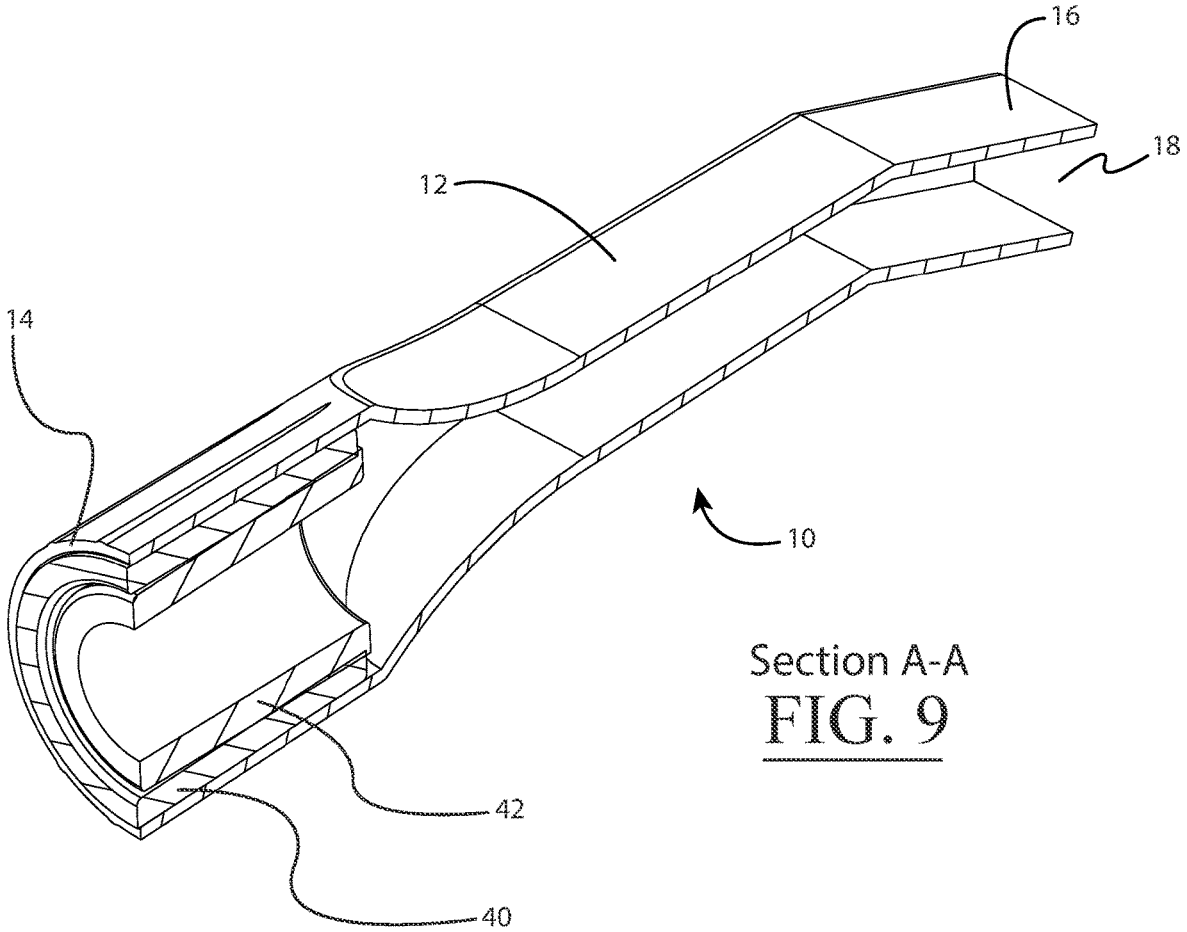
FIG. 9 is a longitudinal sectional view cut through the vacuum attachment, wherein the section is generally cut along the cutting-plane line A-A in FIG. 7.

Now, referring to the illustrative embodiment of FIGS. 1, 2, and 8, it can be seen that the attachment body portion 12 comprises a first channel 28 disposed on a first side of the attachment body portion 12 and a second channel 30 disposed on a second side of the attachment body portion 12. The first side of the attachment body portion 12 is oppositely disposed relative to the second side of the attachment body portion 12. The first channel 28 is bounded by a first channel wall 32 and the second channel 30 is bounded by a second channel wall 34. In the illustrative embodiment, the elongated rod 20 is arranged in a bent configuration across a portion of the air intake aperture 18 of the attachment body portion 12. In the illustrative embodiment, the first end 24 of the elongated rod 20 is received within the first channel 28 on the first side of the attachment body portion 12, and the second end 26 of the elongated rod 20 is received within the second channel 30 on the second side of the attachment body portion 12. As best shown in FIG. 8, in the illustrative embodiment, the bent configuration of the elongated rod 20 is a substantially U-shaped configuration.

Figure 10:
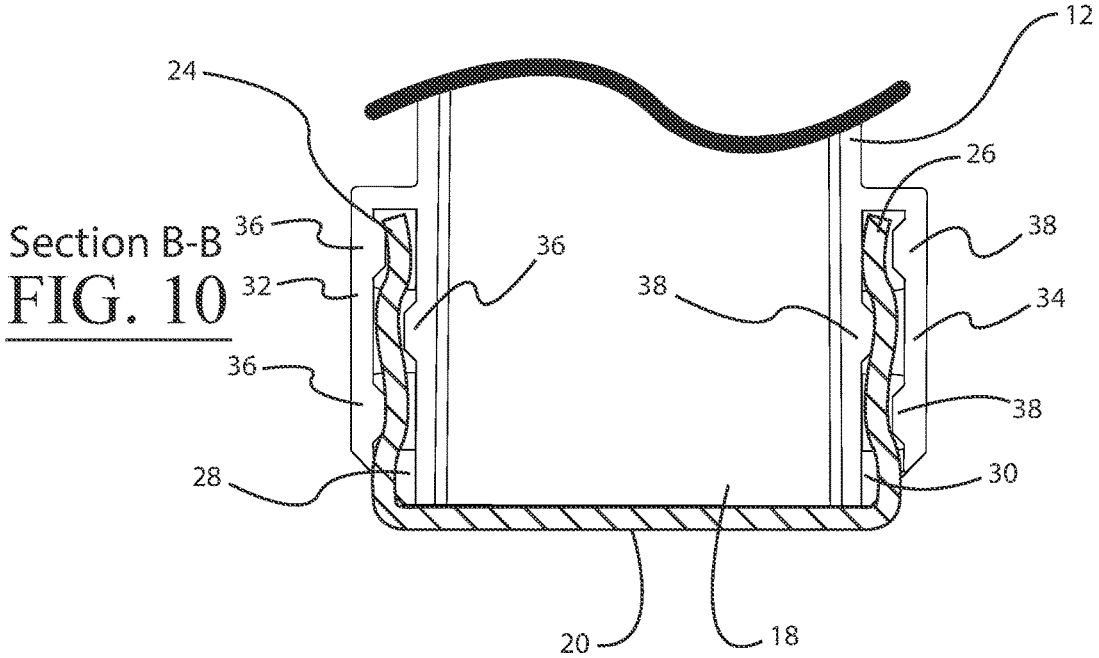
FIG. 10 is a transverse sectional view cut through the distal end portion of the vacuum attachment, wherein the section is generally cut along the cutting-plane line B-B in FIG. 5.

Turning to the sectional view of FIG. 10, in the illustrative embodiment, the first channel 28 comprises a plurality of staggered protrusions 36 disposed therein, and the second channel 30 comprises a plurality of staggered protrusions 38 disposed therein. The pluralities of staggered protrusions 36, 38 define respective passageways with staggered offset portions for securely retaining the elongated rod 20 in place within the first and second channels 28, 30 of the attachment body portion 12.

In the illustrative embodiment, the elongated rod 20 is removably coupled to the attachment body portion 12 via the protrusions 36, 38 of the first and second channels 28, 30 so that the elongated rod 20 is able to be replaced with a new elongated rod after being used to remove the hair and/or fibrous debris from the crevice or surface.

Next, with combined reference to FIGS. 1, 8, and 10, additional features of the elongated rod 20 of the vacuum attachment 10 will be explained. As shown in these figures, the elongated rod 20 includes the plurality of protruding elements 22 projecting outwardly from the elongated rod 20. In the illustrative embodiment, the plurality of protruding elements 22 are disposed around the outer periphery of the elongated rod 20 and along the length of the elongated rod 20 between the first end 24 and the second end 26. Also, in the illustrative embodiment, the elongated rod 20 of the vacuum attachment 10 further comprises a central core portion and an outer covering bonded to the central core portion. In the illustrative embodiment, the outer covering is formed from a hook material strip. More specifically, in the illustrative embodiment, the hook material strip is made from a hook portion of a hook-and-loop fastener material (e.g., made from the hook portion of Velcro®). As such, in the illustrative embodiment, the hook elements of the hook material strip (e.g., the hook portion of Velcro®) form the plurality of protruding elements 22 of the elongated rod 20 of the vacuum attachment 10.

In one or more embodiments, the central core portion of the elongated rod 22 of the vacuum attachment 10 is formed from a semi-flexible cable. In these one or more embodiments, the semi-flexible cable comprises a plurality of inner metal wires surrounded by an outer plastic sheathing. In the illustrative embodiment, the hook material strip is bonded to the outer plastic sheathing of the semi-flexible cable (e.g., the hook portion of Velcro® is glued onto the outer plastic sheathing of the cable). One or more ends 24, 26 of the central core portion of the elongated rod 22 may be terminated by soldering the inner metal wires of the central core portion so as to avoid loose protruding wires, and to give a more finished appearance to the elongated rod 22. In these one or more embodiments, the semi-flexible cable, which is used for the central core portion of the elongated rod 20 of the vacuum attachment 10, may comprise a plastic-coated aircraft cable with a 7⁄32 inch diameter and a 7×19 wire configuration. In other embodiments, other types of cable are used for the central core portion of the elongated rod 22 of the vacuum attachment 10. For example, the semi-flexible cable that is used for the central core portion of the elongated rod 20 of the vacuum attachment 10 may have a different wire configuration (e.g., a 1×19 wire configuration), which results in a stiffer wire core portion with fewer strands of wires.

In one or more other embodiments, the central core portion of the elongated rod 20 of the vacuum attachment 10 is formed from a plastic core, rather than the semi-flexible cable described above. For example, the plastic core version of the elongated rod 20 may be used for applications where a more rigid elongated rod 20 is needed. In these one or more embodiments utilizing a plastic core, the hook material strip is bonded to the outer periphery of the plastic core (e.g., the hook portion of Velcro® is glued onto the outer periphery of the plastic core). One or more ends 24, 26 of the plastic core of the elongated rod 20 of the vacuum attachment 10 may be terminated by dipping the end of the elongated rod 22 in glue or plastic so as to avoid sharp edges, and to give a more finished appearance to the elongated rod 20.

In one or more embodiments, the micro-hook material is attached to a flexible, rod substrate which is made in determined lengths matching the various widths of different sizes vacuum attachments and is attached to the air intake end of the vacuum attachment 10. The micro-hook rod "rake" appendage is formed by using the hook portion of a hook-and-loop textile material (e.g., the hook portion of Velcro®). The material may be formed over a plastic coated metal wire of the appropriate length and bent into a "U" shape to fit tightly into channels 28, 30 on either side of the vacuum opening of the vacuum attachment 10. The "U" shaped micro-hook rod appendage is attached to the front of the vacuum attachment 10 where it will touch the carpet or similar cleaning surface and dislodge hair and debris versus the front of the vacuum attachment 10 itself or an attached brush. The micro-hook rod is removable and replaceable. In these one or more embodiments, the micro-hook rod is bent into a "U" shape for sliding over the air-intake end of a custom vacuum crevice tool 10 and is inserted into both sides of the crevice tool 10 where there extends a raceway which is molded to a size to tightly accept the micro-hook covered rod.

In these one or more embodiments, the elongated rod 20 of the vacuum attachment 10 utilizes the hook side of the common 2-part hook-and-loop fastener material, not as a holding fastener as it was intended to be used for, but rather as a cleaning aid for grabbing hair. The material is attached to a rod substrate in a way that allows the textile material to be attached to a vacuum tool in the stream of suction air in an effective and novel way. This works surprisingly well especially on the wiry carpet fibers of car mats because the micro-hooks of the hook material pull the hair away from the auto carpet fibers by grabbing, and tenaciously holding onto the ground-in hair which is in the carpet. The micro-hooks located in the air suction stream of the front of a vacuum attachment 10 pull the hair free from the carpet with more holding force than a traditional straight bristle brush, giving the vacuum suction the ability to suck-up the dislodged hair in one pass, rather than with the multiple back and forth rubbing motions that are necessary with a typical brush or rubber bristle tool found with today's vacuum attachments. The benefit of the novel, new device 10 is a significant savings in cleaning time, which is every homeowner's goal.

In other embodiments, the plurality of protruding elements 22 of the elongated rod 20 of the vacuum attachment 10 may comprise other suitable forms. For example, in other embodiments, the plurality of protruding elements of the elongated rod are in the form of a plurality of injection-molded micro-hook elements configured to grab and collect the hair and/or debris from the rotary brush being cleaned.

In these other embodiments, the plurality of injection-molded micro-hook elements may be in the form of inverted J-shaped projections and T-shaped projections protruding outwardly from the elongated rod. The plurality of injection-molded micro-hook elements may be disposed on opposite first and second sides of the elongated rod. As one example, two rows of injection-molded micro-hook inverted J-shaped elements may be provided on each side of the elongated rod, while one row of injection-molded micro-hook T-shaped elements may be provided on each of the top and bottom of the elongated rod. Also, the injection-molded micro-hook inverted J-shaped elements that are disposed on the first side and the second side of the elongated rod may be arranged in rows where every other injection-molded micro-hook element points in an opposite direction (i.e., the injection-molded micro-hook elements point in alternating directions along the length of the elongated body). In addition, in these other embodiments, the injection-molded micro-hook inverted J-shaped elements that are disposed on the first side and the second side of the elongated rod may comprise two rows of micro-hook elements with free ends that point in generally opposite directions (e.g., refer to FIGS. 10-12 in U.S. Pat. No. 10,857,577, the entire disclosure of which is incorporated herein by reference).

Figure 3:
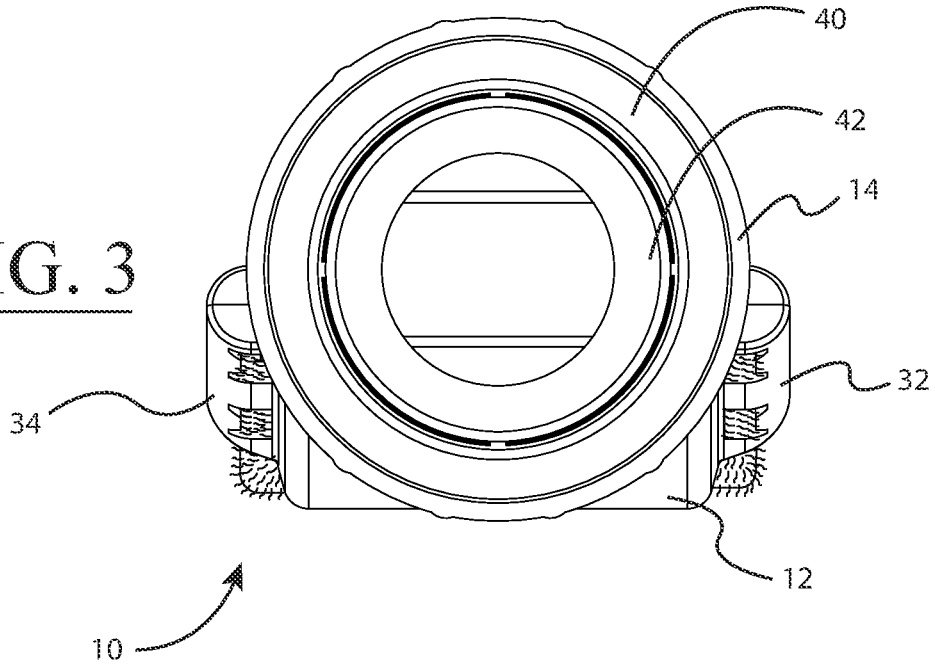
FIG. 3 is a proximal end view of the vacuum attachment of FIG. 1.
Figure 4:
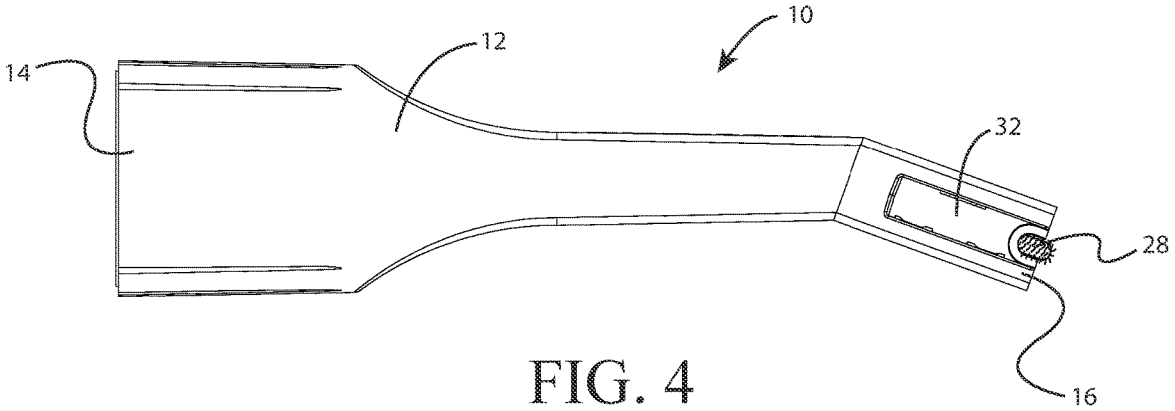
FIG. 4 is a first side elevational view of the vacuum attachment of FIG. 1.
Figure 5:
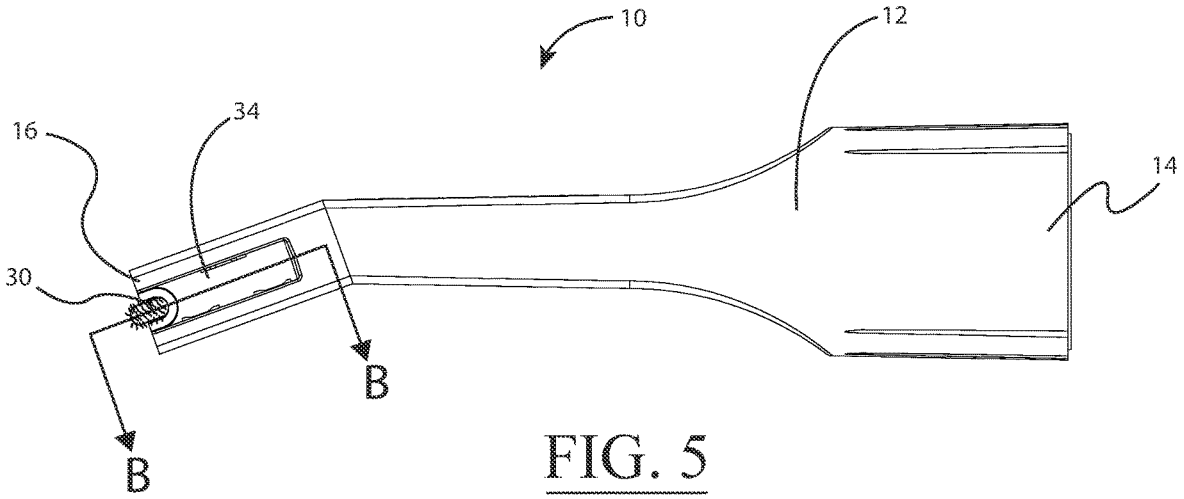
FIG. 5 is a second side elevational view of the vacuum attachment of FIG. 1.
Figure 6:
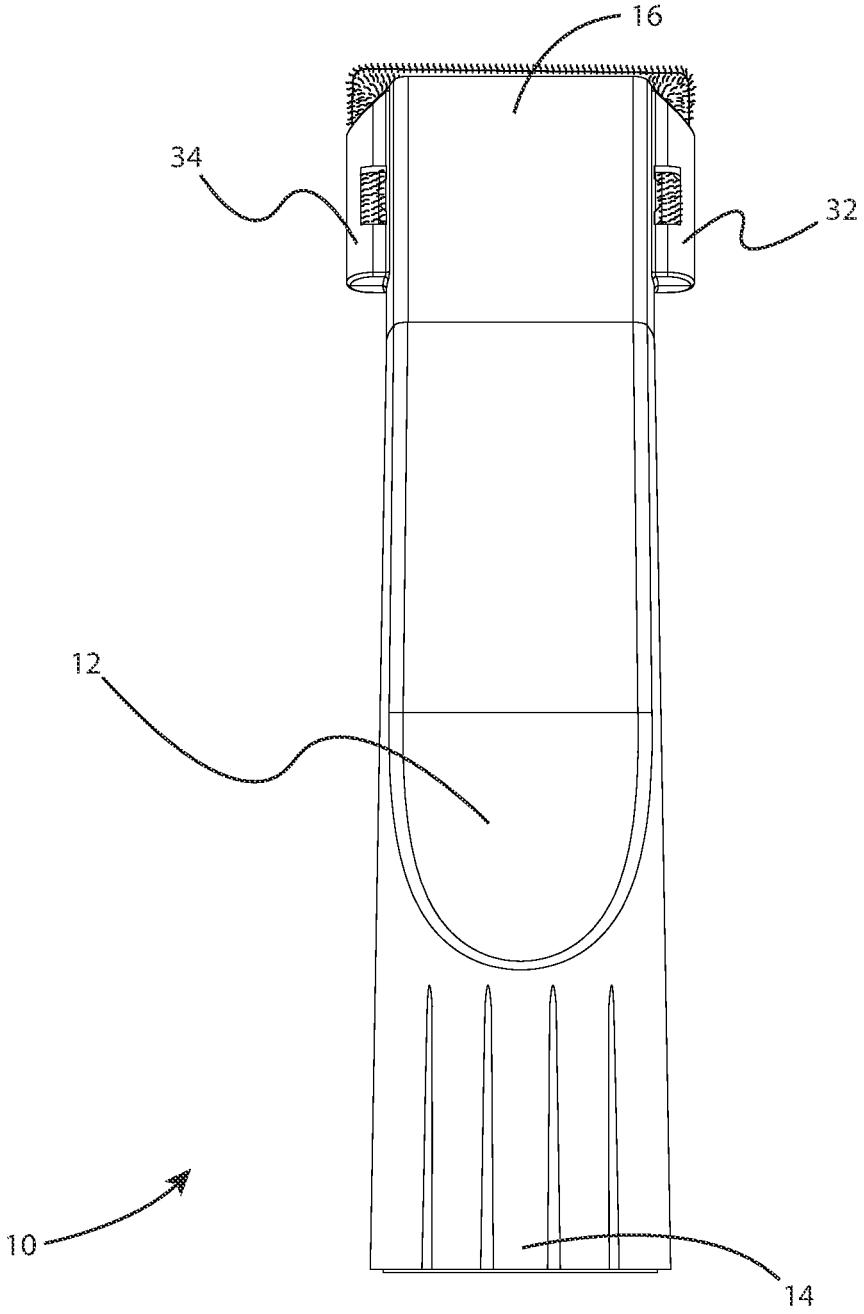
FIG. 6 is a top plan view of the vacuum attachment of FIG. 1.
Figure 7:
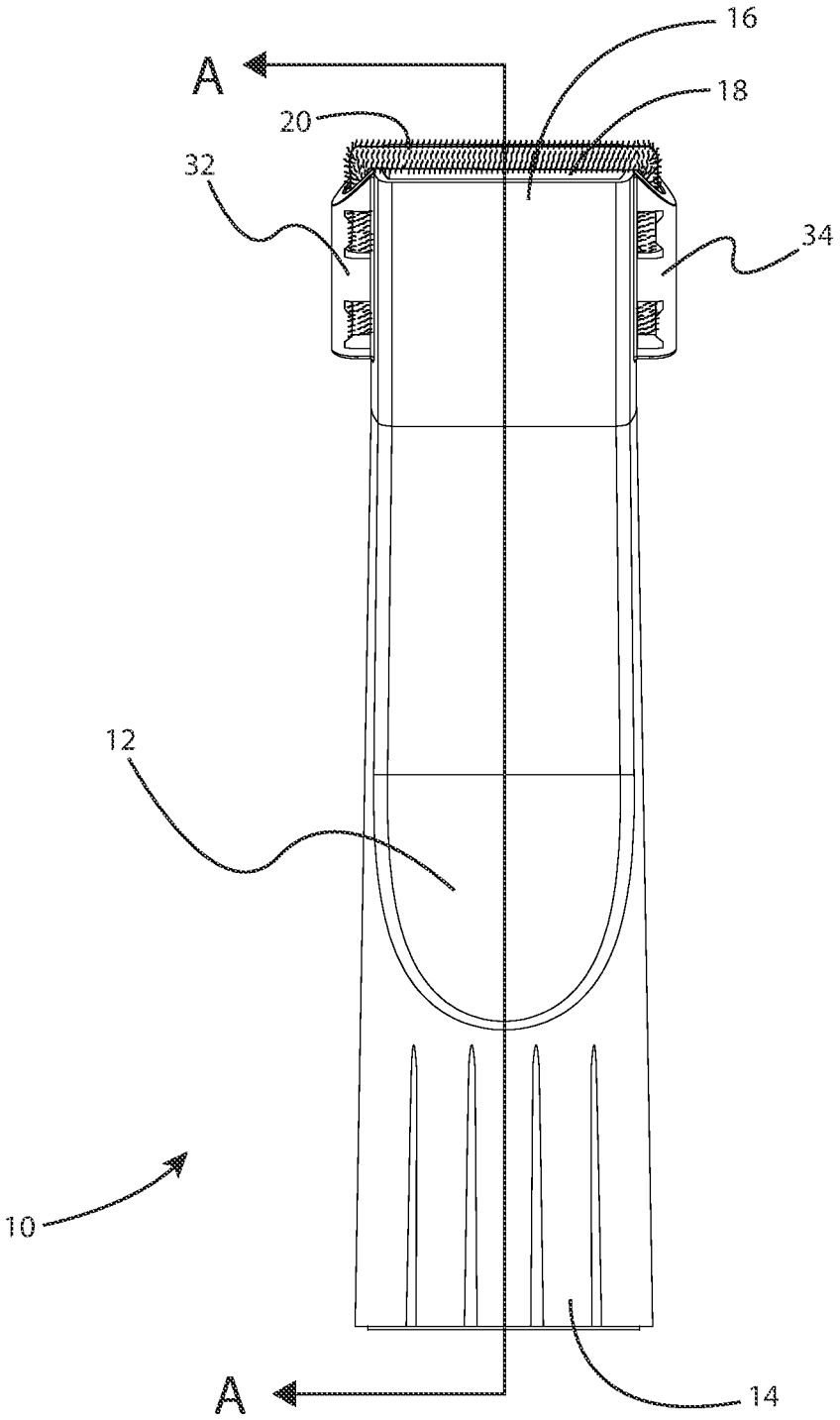
FIG. 7 is a bottom plan view of the vacuum attachment of FIG. 1.

Now, turning to FIGS. 3, 8, and 10, it can be seen that, in the illustrative embodiment, the vacuum attachment 10 further comprises a plurality of insert adapters 40, 42 having different sizes (e.g., 1⅞" and 1¼") so as to accommodate vacuum hose sizes with different connection diameters. Each insert adapter 40, 42 is configured to be inserted into the first end 14 of the attachment body portion 12 so as to enable the vacuum attachment 10 to accommodate a vacuum hose size with a connection diameter that is different than an opening diameter at the first end 14 of the attachment body portion 12 (e.g., refer to the diagram in FIG. 15).

Figure 15:
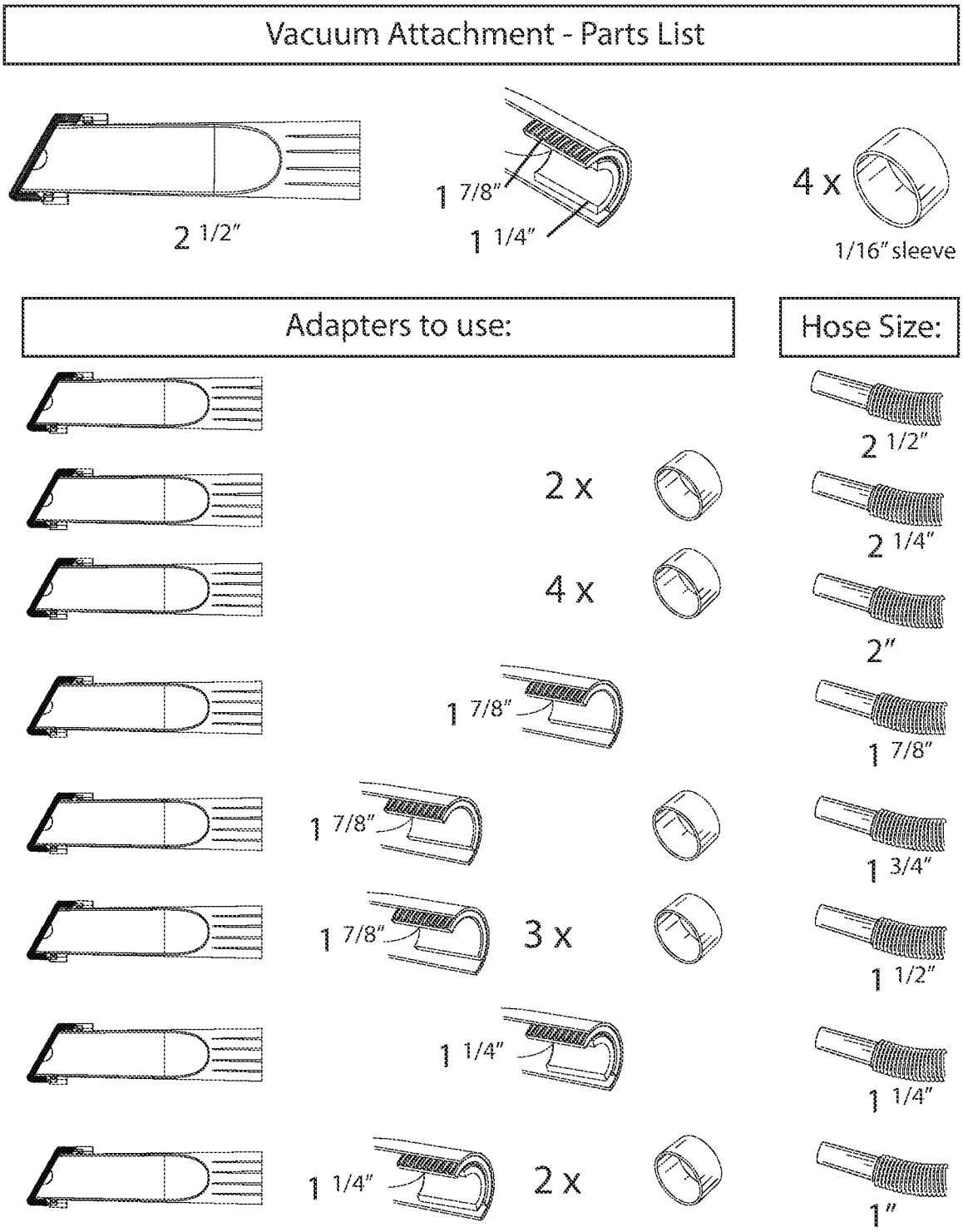
FIG. 15 is a diagram illustrating the various combinations of insert adapters and elastic sleeve members that can be used to accommodate different vacuum hose sizes with different connection diameters.
Figure 16:
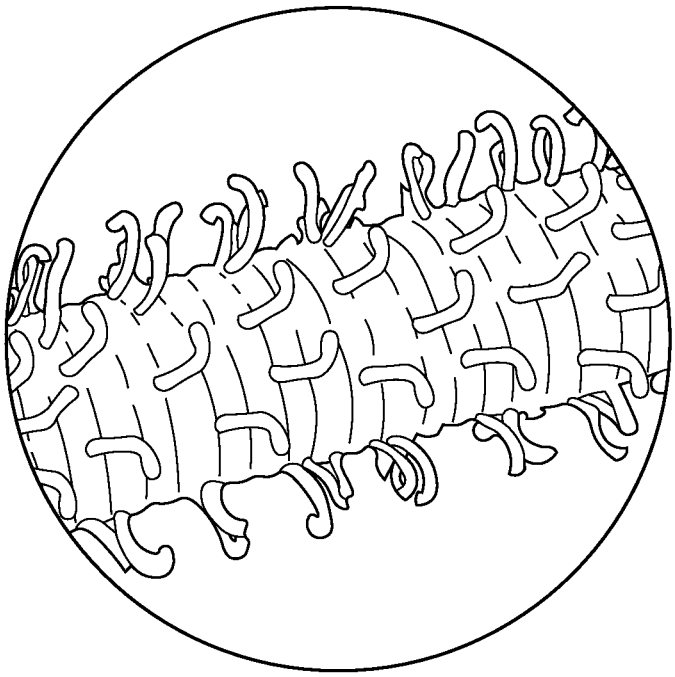
FIG. 16 is an enlarged view of a portion of the elongated rod of the vacuum attachment in FIG. 1, wherein the protruding elements of the elongated rod are illustrated in more detail (Detail "A")
Figure 17:
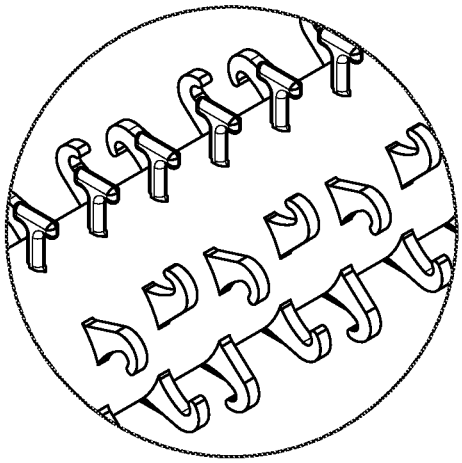
FIG. 17 is an enlarged view of a portion of an alternative elongated rod of the vacuum attachment, wherein the protruding elements of the elongated rod are in a form of injection-molded micro-hook elements (Detail "A" Alternative)
Figure 18:
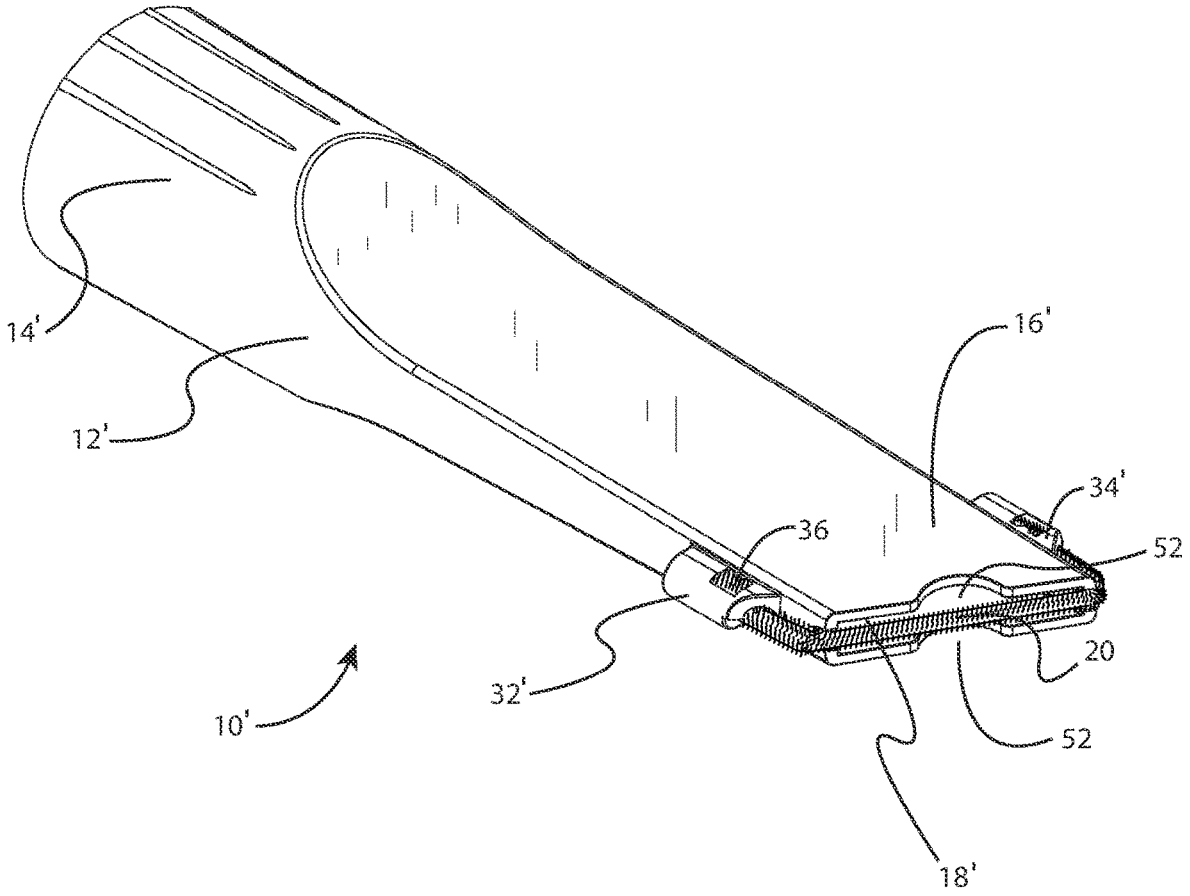
FIG. 18 is a perspective view of a vacuum attachment, according to a second illustrative embodiment of the invention, wherein the vacuum attachment includes an elongated rod with protruding elements disposed across a portion of an air intake aperture of the vacuum attachment.
Figure 19:
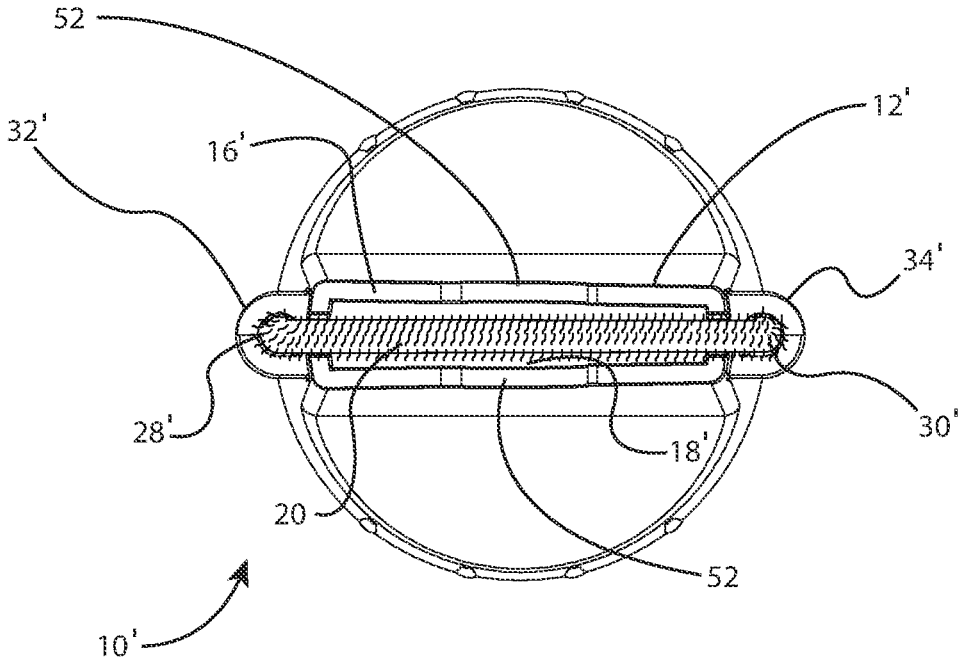
FIG. 19 is a distal end view of the vacuum attachment of FIG. 18.
Figure 20:
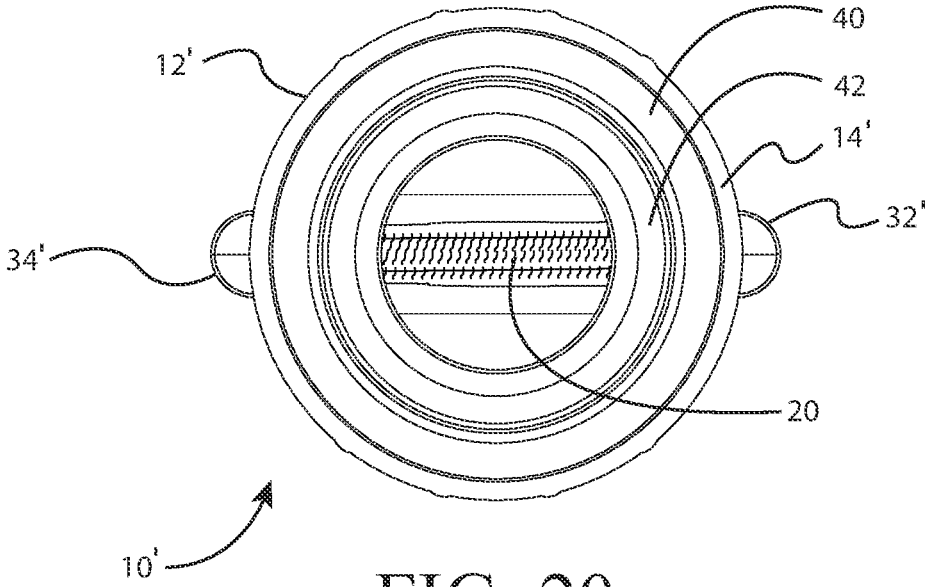
FIG. 20 is a proximal end view of the vacuum attachment of FIG. 18.
Figure 21:
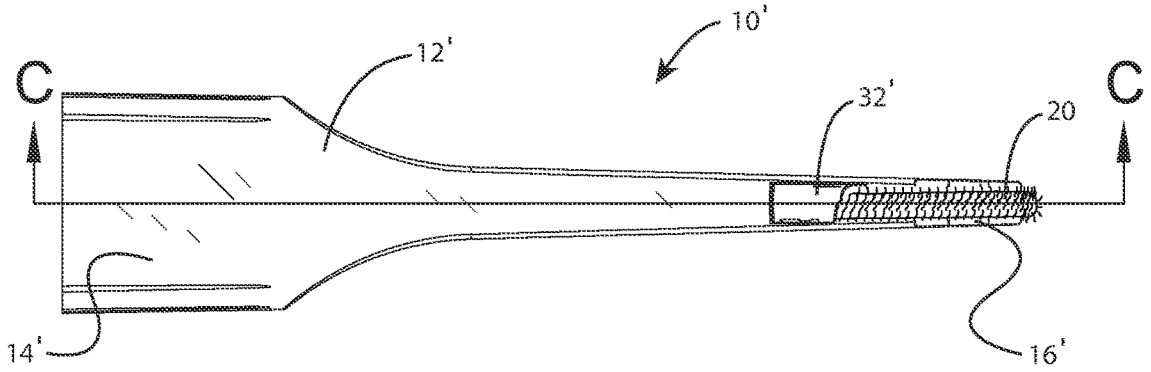
FIG. 21 is a first side elevational view of the vacuum attachment of FIG. 18.
Figure 22:
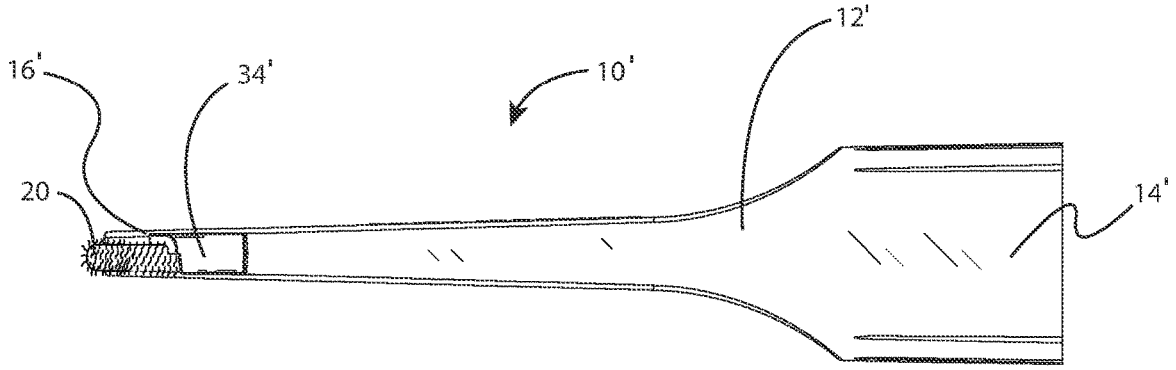
FIG. 22 is a second side elevational view of the vacuum attachment of FIG. 18.
Figure 23:
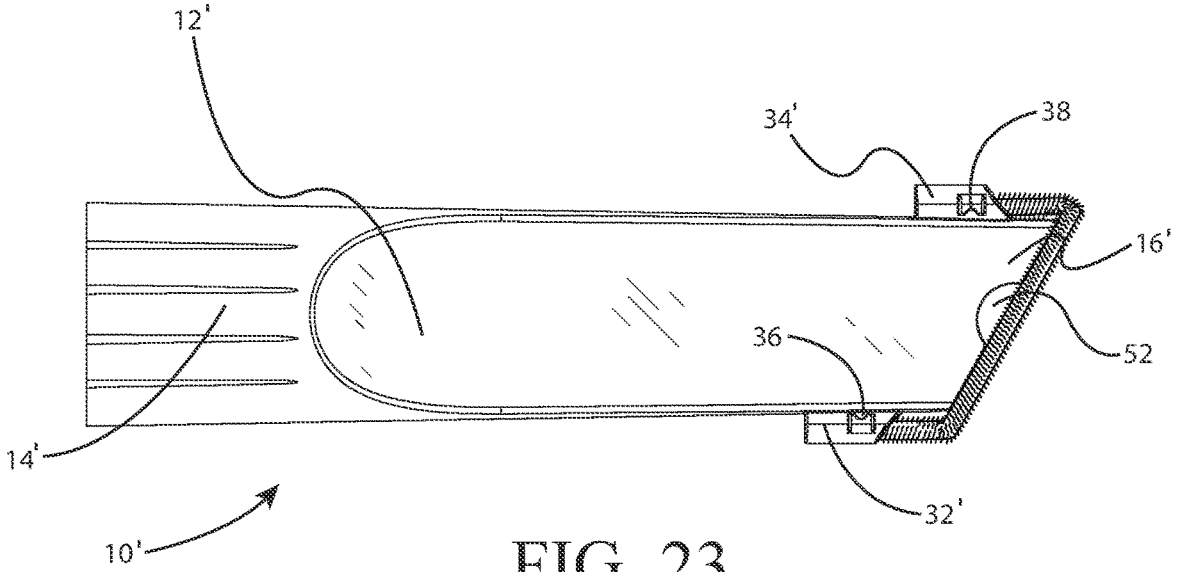
FIG. 23 is a top plan view of the vacuum attachment of FIG. 18.
Figure 24:
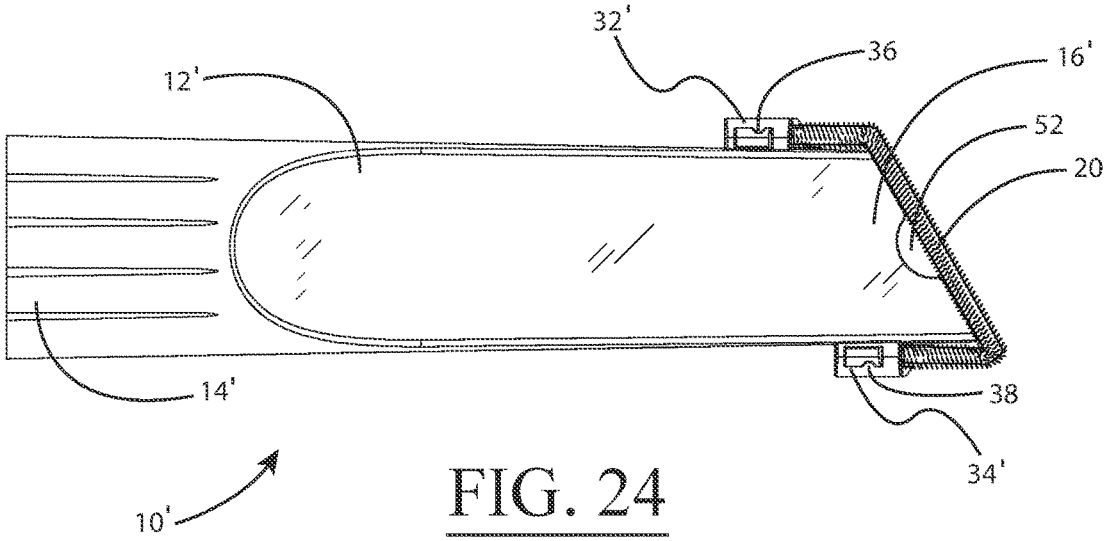
FIG. 24 is a bottom plan view of the vacuum attachment of FIG. 18.

Also, in the illustrative embodiment, referring to FIGS. 8 and 15, the vacuum attachment 10 additionally comprises a plurality of elastic sleeve members 46 that useable together so as to accommodate vacuum hose sizes with different connection diameters. Each elastic sleeve member 46 is configured to operate as a spacer between a first end opening of the attachment body portion 12 and a connection end portion of the vacuum hose so as to enable the vacuum attachment 10 to accommodate a vacuum hose size with a connection diameter that is smaller than the first end opening of the attachment body portion 12 (e.g., refer to the diagram in FIG. 15).

A common frustration currently for vacuum users that want to buy vacuum adapters is that the vacuum hoses and the adapters often do not match in size. Typical sizes of "shop-vac" style vacuums start at 2½ inches in diameter in the largest size and go down to 1 inch in diameter in the smallest size. To prevent this frustration for the user, in the illustrative embodiment, a novel solution for universally adapting a vacuum adapter to any size vacuum is presented that includes two (2) internal downsizing ring adapters along with a number of elastic bands or elastic sleeve members to allow the user to adapt most any size vacuum hose on the market up to the largest 2½ inch hose size of the vacuum attachment 10. In the illustrative embodiment, the vacuum attachment 10 itself is sized to the largest available 2½ inch hose diameter and the user selects one or two of the provided, stackable internal hose adapters to fit their particular vacuum hose size. In the illustrative embodiment, two (2) common hose size internal adapters are provided that convert the vacuum attachment's hose size from 2½ inch to either 1⅞ inch or 1¼ inch by using either one or both of the stackable, internal adapters. If the user's vacuum hose diameter does not exactly match one of the provided internal adapters, then one or more elastic bands or elastic sleeve members are provided, which when stretched over the vacuum cleaner's hose end, will make an air-tight fit between the crevice tool 10 and the vacuum hose for vacuuming. The elastic bands or elastic sleeve members may be of various widths and thicknesses, however in the illustrative embodiment, the user is provided with four (4) bands which are 1½ inch wide and 1/16 inch thick and of a diameter and stretch profile that allow them to fit snugly over a variety of diameters varying from 1 inch to 2½ inch. In the illustrative embodiment, the bands are made of very low Shore A hardness materials that are compressible, stretchy and durable. Such materials include but are not limited to silicones, rubbers, and various forms of thermoplastic elastomers, thermoplastic vulcanizates and thermoplastic polyurethanes. The user then can apply as many bands as he or she needs in 1/16 inch increments to create a snug fit between his or her current vacuum hose size and the 2½ inch hose end of the vacuum attachment 10 (see attached sample adapter instruction sheet 60 shown in FIG. 15).

An alternative illustrative embodiment of a combined stepped one-piece insert adapter 62 having both 1¼" and 1⅞" aperture sizes is shown in FIGS. 27-32. In the illustrative embodiment of FIGS. 27-32, two different-sized reducer adapters have been combined into a one-piece stepped insert adapter 62. The single stepped insert adapter 62 of FIGS. 27-32 is an alternative to the stackable internal hose adapters described above. The one-piece stepped insert adapter 62 of FIGS. 27-32 includes the same 1¼" and 1⅞" apertures as stackable hose adapters, and operates in the same manner as the stackable internal hose adapters when used in combination with the stackable elastic sleeves so as to cover most, or all hose sizes.

Figure 27:
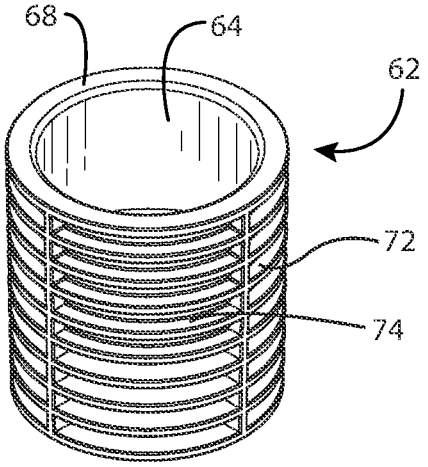
FIG. 27 is a top-side perspective view of a one-piece insert adapter, according to an illustrative embodiment of the invention.
Figure 28:
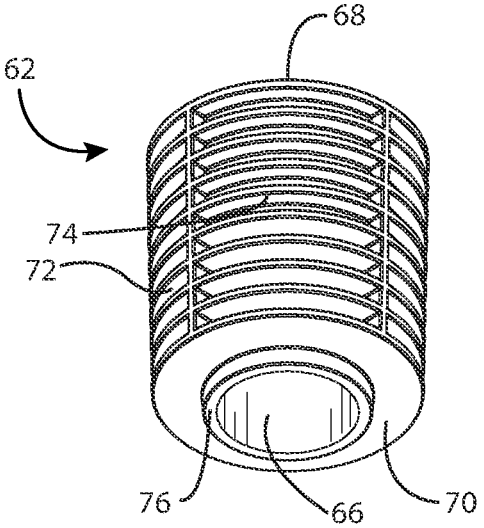
FIG. 28 is a bottom-side perspective view of the one-piece insert adapter of FIG. 27.
Figure 29:
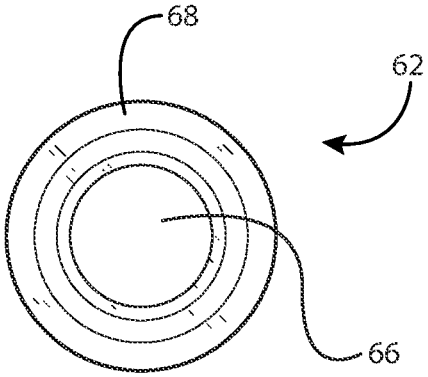
FIG. 29 is a first end view of the one-piece insert adapter of FIG. 27.
Figure 30:
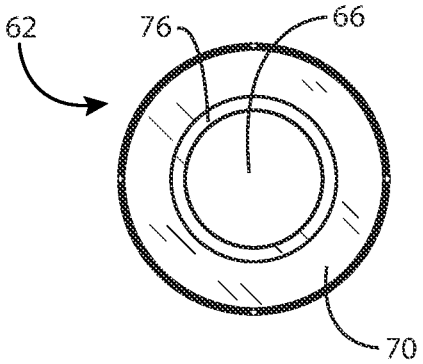
FIG. 30 is a second end view of the one-piece insert adapter of FIG. 27.
Figure 31:
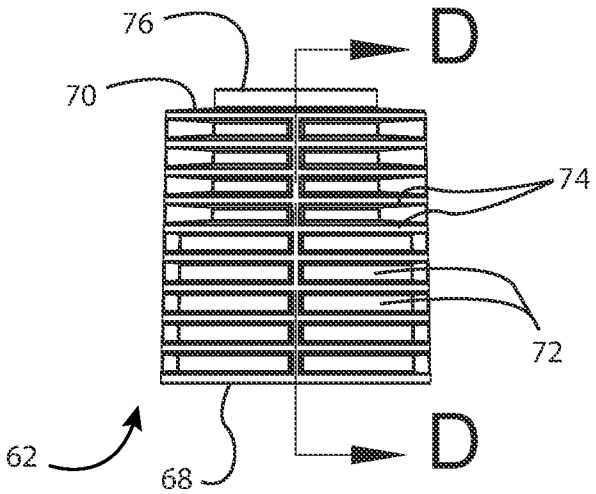
FIG. 31 is a side elevational view of the one-piece insert adapter of FIG. 27.
Figure 32:
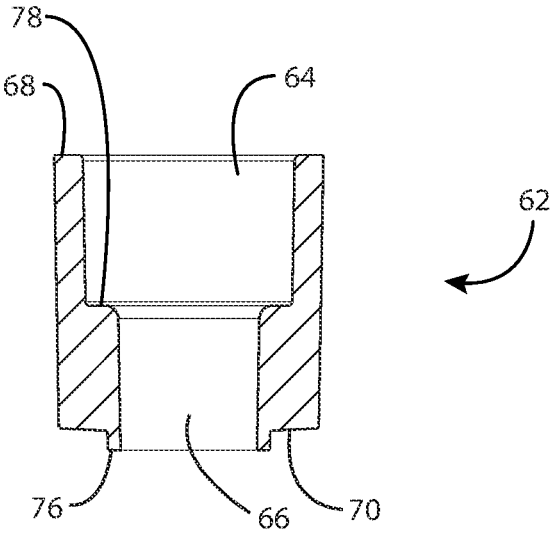
FIG. 32 is a longitudinal sectional view cut through the one-piece insert adapter, wherein the section is generally cut along the cutting-plane line D-D in FIG. 31.

Referring again to FIGS. 27-32, it can be seen that the one-piece insert adapter 62 comprises a 1⅞" aperture 64 at a first end 68 of the adapter body portion and a 1¼" aperture 66 at a second end 70 of the adapter body portion. In the cross-sectional view of FIG. 32, it can be seen that the adapter body portion further comprises an internal ledge 78 extending between the different-sized apertures 64, 66. Also, as best shown in FIGS. 27, 28, and 31, it can be seen that the outer wall of the adapter body portion comprises a plurality of ribs 74 that are longitudinally spaced apart from one another by gaps 72. In addition, with reference to FIGS. 28 and 32, it can be seen that the second end 70 of the adapter body portion comprises a protruding rim 76 extending outwardly therefrom.

Figure 11:
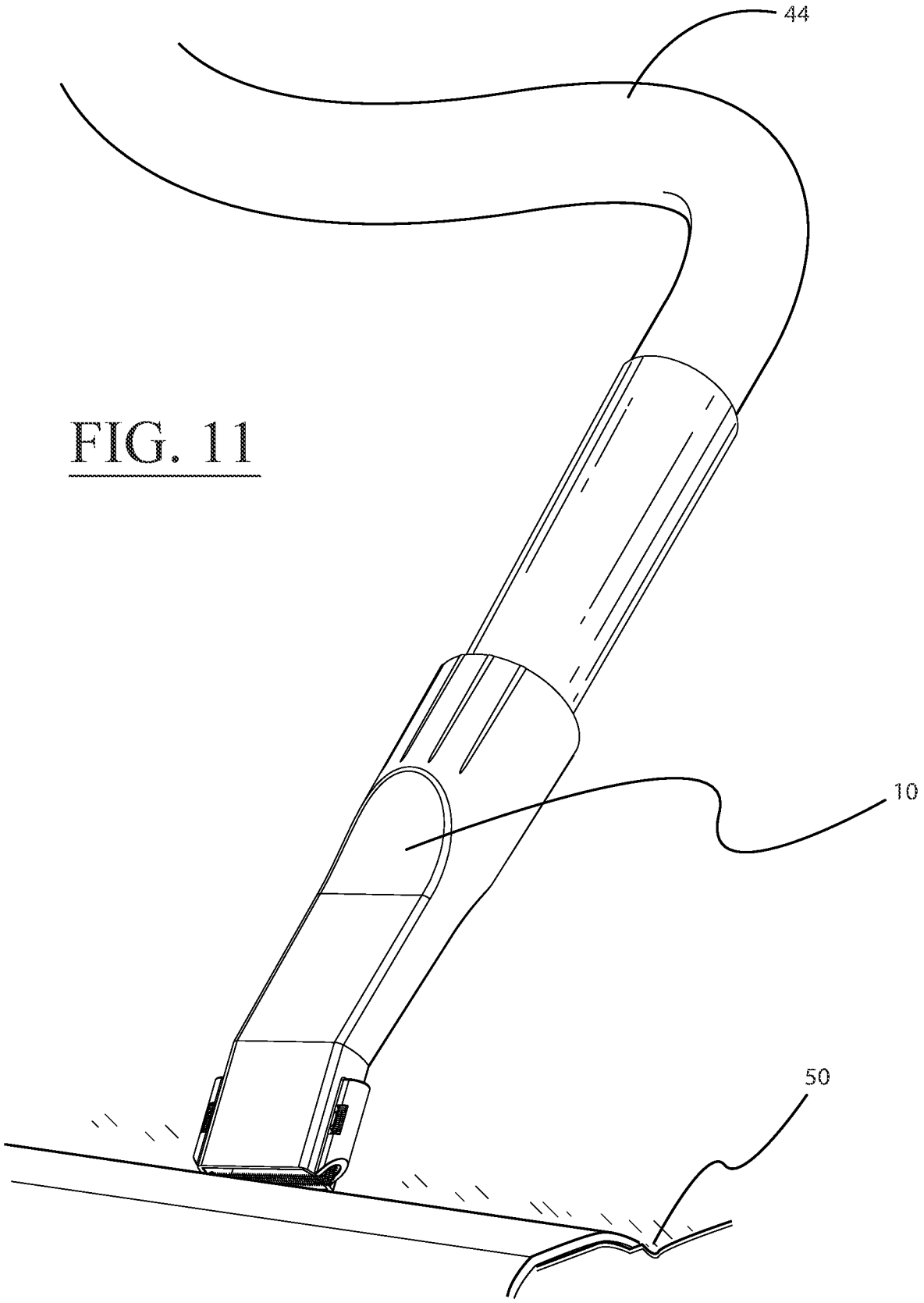
FIG. 11 is a perspective view illustrating the manner in which the vacuum attachment of FIG. 1 may be used to clean hair and/or fibrous debris from a crevice.

As one example of an application for the vacuum attachment 10, in FIG. 11, the vacuum attachment 10 is shown being used for cleaning hair, fibrous debris, and/or particulate matter from a crevice 50 in a vehicle.

Another illustrative embodiment of the vacuum attachment is seen generally at 10' in FIGS. 18-26. Referring to these figures, it can be seen that, in many respects, the illustrative embodiment of FIGS. 18-26 is similar to that of the illustrative embodiment of FIGS. 1-9. Moreover, many elements are common to both such embodiments. For the sake of brevity, the elements that the illustrative embodiment of FIGS. 18-26 has in common with the embodiment of FIGS. 1-9 will not be discussed in detail because these components have already been described above.

Like the vacuum attachment 10 described above, the vacuum attachment 10' of the illustrative embodiment of FIGS. 18-26 generally comprises an attachment body portion 12', the attachment body portion 12' having a first end 14' (i.e., the proximal end 14') and a second end 16' (i.e., the distal end 16'), the first end 14' of the attachment body portion 12' being oppositely disposed relative to the second end 16' of the attachment body portion 12', the first end 14' of the attachment body portion 12' configured to be connected to a vacuum hose 44 (see e.g., FIG. 11), and the attachment body portion 12' defining an air intake aperture 18' at the second end 16' of the attachment body portion 12'; and an elongated rod 20 disposed across a portion of the air intake aperture 18' at the second end 16' of the attachment body portion 12', the elongated rod 20 having a first end 24 and a second end 26, the first end 24 of the elongated rod 20 being oppositely disposed relative to the second end 26 of the elongated rod 20, the elongated rod 20 including a plurality of protruding elements 22 projecting outwardly from the elongated rod 20, the plurality of protruding elements 22 being disposed around a periphery of the elongated rod 20 and along at least a portion of a length of the elongated rod 20 between the first end 24 and the second end 26. In the illustrative embodiment, the plurality of protruding elements 22 of the elongated rod 20 are configured to grab and collect the hair and/or fibrous debris from the crevice or surface being cleaned by the vacuum attachment 10'.

Figure 25:
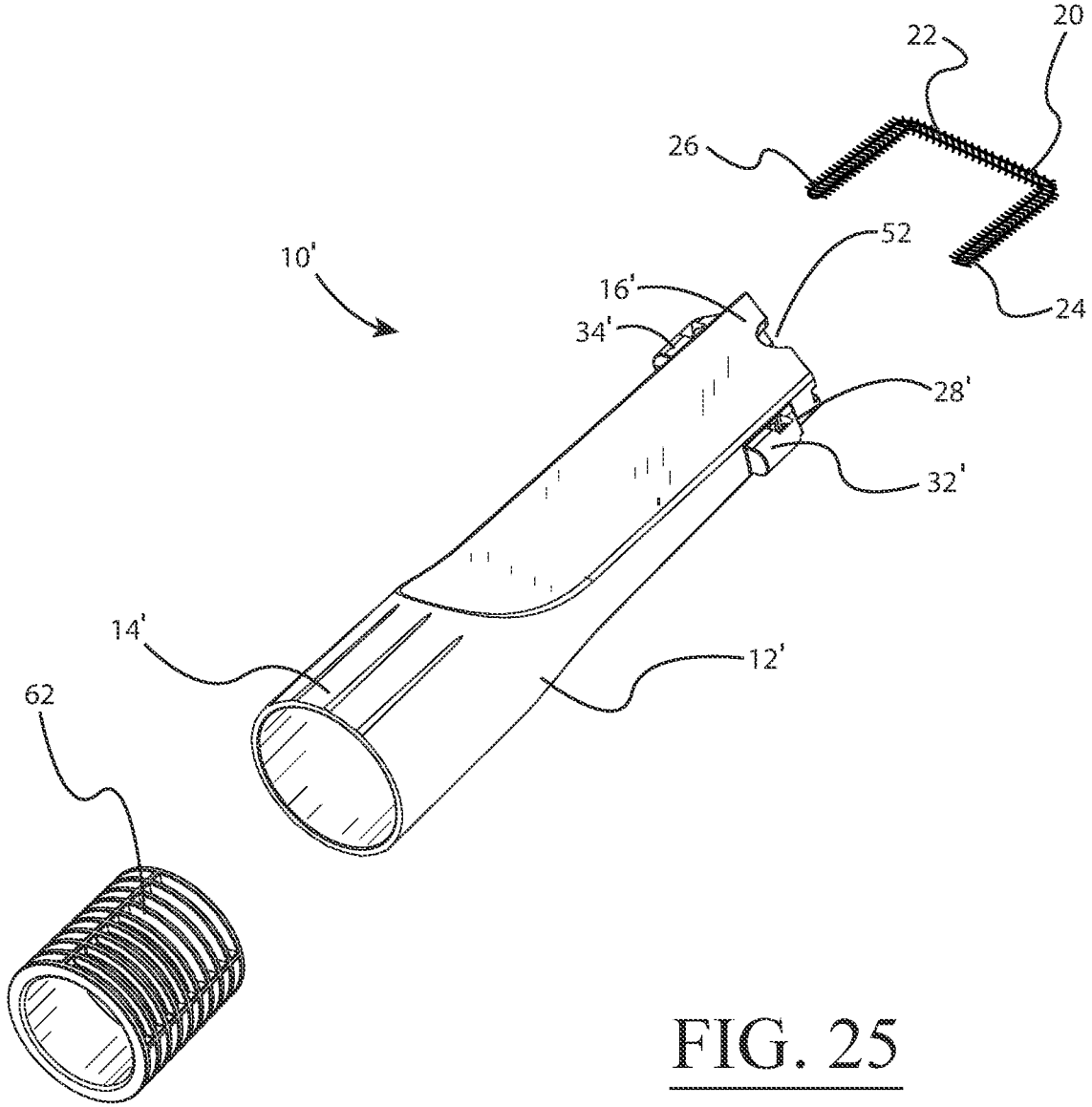
FIG. 25 is an exploded perspective view of the vacuum attachment of FIG. 18.
Figure 26:
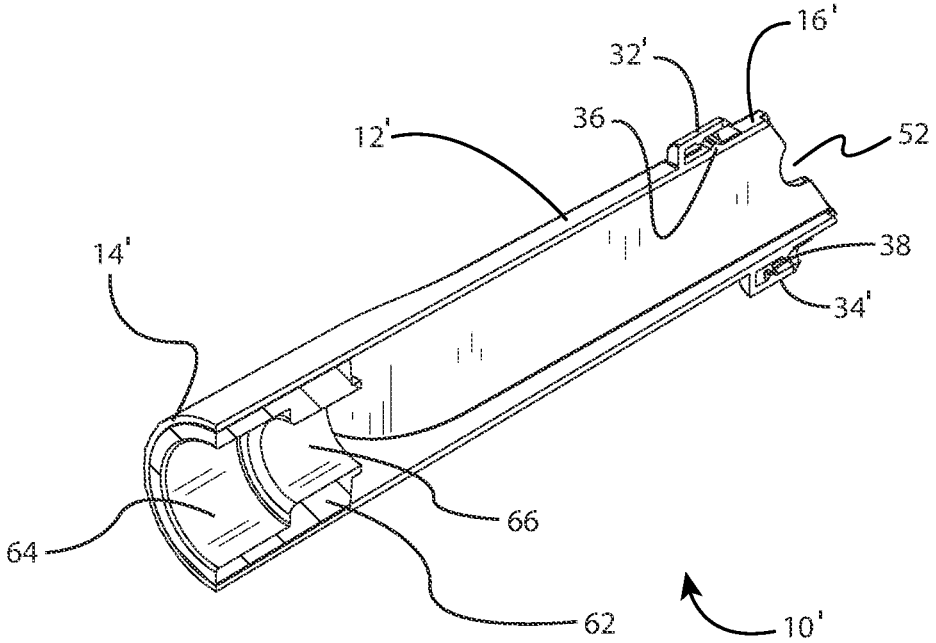
FIG. 26 is a longitudinal sectional view cut through the vacuum attachment, wherein the section is generally cut along the cutting-plane line C-C in FIG. 21.

Also, similar to the illustrative embodiment of FIGS. 1-9, it can be seen that the attachment body portion 12' of the illustrative embodiment of FIGS. 18-26 comprises a first channel 28' disposed on a first side of the attachment body portion 12' and a second channel 30' disposed on a second side of the attachment body portion 12'. The first side of the attachment body portion 12' is oppositely disposed relative to the second side of the attachment body portion 12'. The first channel 28' is bounded by a first channel wall 32' and the second channel 30' is bounded by a second channel wall 34'. In the illustrative embodiment, the elongated rod 20 is arranged in a bent configuration across a portion of the air intake aperture 18' of the attachment body portion 12'. In the illustrative embodiment, the first end 24 of the elongated rod 20 is received within the first channel 28' on the first side of the attachment body portion 12', and the second end 26 of the elongated rod 20 is received within the second channel 30' on the second side of the attachment body portion 12'. As best shown in FIG. 25, in the illustrative embodiment, the bent configuration of the elongated rod 20 is a substantially U-shaped configuration.

Referring again to FIGS. 18-26, it can be seen that the second end 16' of the attachment body portion 12' of the illustrative embodiment of FIGS. 18-26 has a different shape than the illustrative embodiment of FIGS. 1-9. More particularly, the second end 16' of the attachment body portion 12' has a thinner, angled end configuration that is different from the illustrative embodiment of FIGS. 1-9. For example, as shown in FIGS. 18 and 23-25, the end of attachment body portion 12' may cut at an approximately 45-degree angle from one side of the attachment body portion 12' to the other side of the attachment body portion 12'. Advantageously, the thinner, vertically oriented, 45-degree attachment body portion 12' of FIGS. 18-26 is able to readily fit along the edges of seats in a vehicle and easily get into narrow areas being vacuumed. For example, in the illustrative embodiment, the second suction end 16' of the attachment body portion 12' may have a thickness that is approximately one-half of an inch (e.g., a ½" thickness with a +/−1/16" variation) to effectively fit into tight spaces. In other words, the second suction end 16' of the attachment body portion 12' may have a thickness that is between approximately 7/16" and approximately 9/16", inclusive (or between 7/16" and 9/16", inclusive). However, when the second suction end 16' of the attachment body portion 12' is made thinner as in the embodiment of FIGS. 18-26, there is a great tendency for objects, such as rocks, getting caught between the elongated rod 20 and the walls of the air intake opening 18' in the attachment body portion 12'. As such, as shown in FIGS. 18 and 23-25, the attachment body portion 12' is provided with two (2) semicircular cutouts 52 disposed on opposite sides of the attachment body portion 12' so as to enable some larger objects to get sucked into the attachment body portion 12' at the cutout areas 52, while still keeping the attachment body portion 12' thinner so that the second suction end 16' of the vacuum attachment 10' is more easily insertable into narrow areas being vacuumed.

Figure 12:
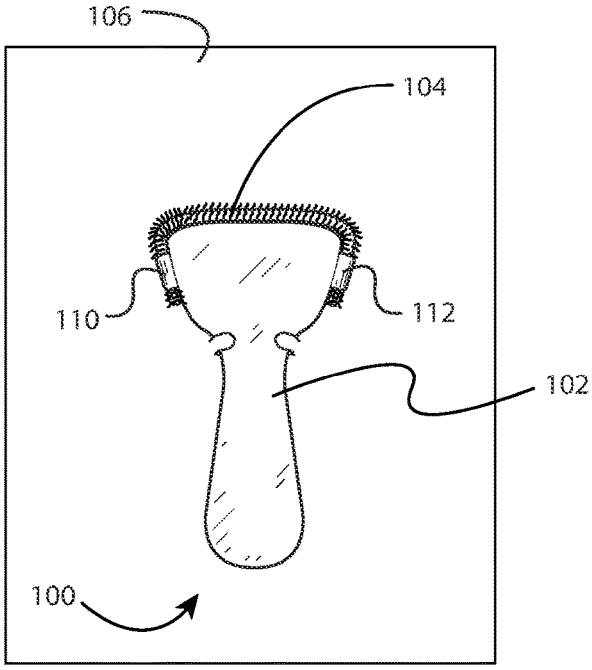
FIG. 12 is a front side elevational view of a manual brush and a brush holder used with the manual brush, according to an illustrative embodiment of the invention, wherein the manual brush includes an elongated rod with protruding elements disposed across a distal end portion of the manual brush.
Figure 14:
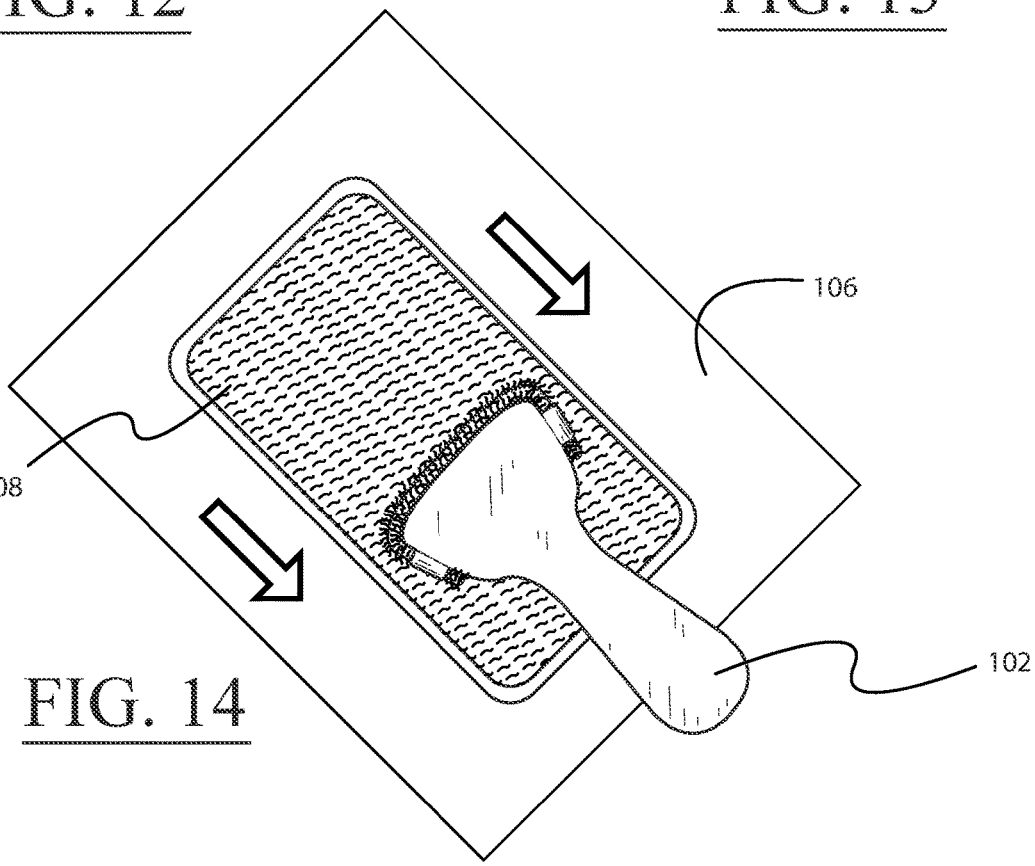
FIG. 14 is another rear side elevational view of the brush holder of FIG. 12, wherein the manual brush is being cleaned using the cleaning hook section on the rear side of the brush holder.

An illustrative embodiment of a manual brush is seen generally at 100 in FIGS. 12 and 14. Like the vacuum attachment 10, 10' described above, the manual brush 100 also is used for removing hair and/or fibrous debris from a crevice or surface being cleaned. With initial reference to FIG. 12, it can be seen that the manual brush 100 generally comprises a handle portion 102, the handle portion 102 having a first end and a second end, the first end of the handle portion 102 being oppositely disposed relative to the second end of the handle portion 102, the first end of the handle portion 102 configured to be grasped by a user; and an elongated rod 104 attached to the second end of the handle portion 102, the elongated rod 104 having a first end and a second end, the first end of the elongated rod 104 being oppositely disposed relative to the second end of the elongated rod 104, the elongated rod 104 including a plurality of protruding elements projecting outwardly from the elongated rod 104, the plurality of protruding elements being disposed around a periphery of the elongated rod 104 and along at least a portion of a length of the elongated rod 104 between the first end and the second end. In the illustrative embodiment, the plurality of protruding elements of the elongated rod 104 are configured to grab and collect the hair and/or fibrous debris from the crevice or surface being cleaned by the manual brush 100.

Now, referring again to the illustrative embodiment of FIG. 12, it can be seen that the handle portion 102 comprises a first attachment member 110 disposed on a first side of the handle portion 102 and a second attachment member 112 disposed on a second side of the handle portion 102. The first side of the handle portion 102 is oppositely disposed relative to the second side of the handle portion 102. In the illustrative embodiment, the elongated rod 104 is arranged in a bent configuration on the second end of the handle portion 102. The first end of the elongated rod 104 engages with the first attachment member 110 on the first side of the handle portion 102, and the second end of the elongated rod 104 engages with the second attachment member 112 on the second side of the handle portion 102.

In the illustrative embodiment, similar to that described above for the elongated rod 20 of the vacuum attachment 10, 10', the elongated rod 104 of the manual brush 100 is removably coupled to the handle portion 102 so that the elongated rod 104 is able to be replaced with a new elongated rod after being used to remove the hair and/or fibrous debris from the crevice or surface. The construction of the elongated rod 104 of the manual brush 100 is generally the same as that described above for the elongated rod 20 of the vacuum attachment 10, 10' (e.g., hook-and-loop fastener material used, etc.).

Figure 13:
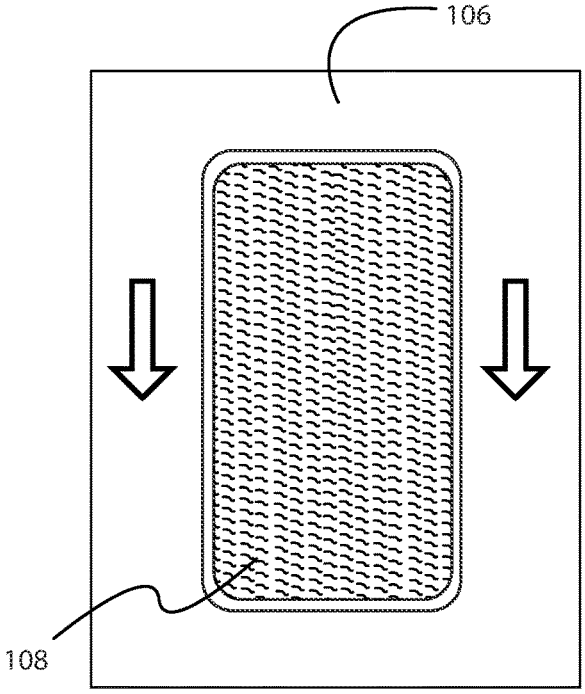
FIG. 13 is a rear side elevational view of a brush holder of FIG. 12.

Next, referring to FIGS. 13 and 14, the brush holder 106 of the illustrative embodiment of the manual brush 100 will be described. In the illustrative embodiment, the brush holder 106 has a first side (see FIG. 12) and a second side (see FIG. 13), where the first side of the brush holder 106 is oppositely disposed relative to the second side of the brush holder 106. In the illustrative embodiment, the handle portion 102 of the manual brush 100 is configured to be removably coupled to the first side of the brush holder 106 (see FIG. 12), and the second side of the brush holder 106 comprises a cleaning hook section 108 with a plurality of protruding elements for cleaning the elongated rod 104 of the manual brush (see FIG. 13).

The illustrative manual brush 100 is a less expensive, "manual" version of the hair-dislodging vacuum crevice tool device 10, 10' described above, except that it does not attach to a vacuum or a vacuum attachment. In one or more embodiments, the device 100 has a handle portion 102 like a hairbrush, but rather than having the traditional straight nylon/rubber bristles, the body of the device 100 utilizes the micro-hook covered rod 104. The micro-hook covered rod 104 rakes up hair and fibrous debris that frequently gets lodged in carpet and upholstery material in the same fashion as the vacuum attachment embodiment. The less expensive hairbrush embodiment consequently accumulates the extracted hair rather than being taken away by the vacuum air suction of the vacuum cleaner. In order to clean the accumulated hair and fibrous debris off of the manual brush 100, the brush device 100 comes in a snap-in, plastic holder 106 that has a cleaning surface 108 on the reverse side of the plastic holder 106. The cleaning surface 108 comprises rows of injection molded micro-hooks, which are similar to the micro-hook rod material, except that the multiple rows of molded hooks are all oriented in the same direction with arrows (see FIG. 14) signifying the direction of motion necessary to clean the accumulated hair and fibrous debris off of the manual brush device 100 by brushing it over the molded cleaning micro-hooks in the direction specified by the arrows. Once the manual brush device 100 is cleaned, the user can wipe off the extracted hair and fibrous debris from the device 100 by moving it over the cleaning array of molded micro-hooks in the opposite direction of the arrows to release the hair debris off the micro-hooks and discard it in the wastebasket.

Benefits of the manual brush device 100 are that it is less expensive to manufacture, smaller in size for sale and storage and more convenient for the user for small, quick clean up jobs by not having to haul out a vacuum cleaner as is required for the vacuum attachment 10, 10' described above.

Advantageously, the vacuum attachment 10, 10' and manual brush 100 of the illustrative embodiments provide innovative solutions for faster and more thorough cleaning of hair and fibrous matter from carpets, furniture, car mats, and similar surfaces. In one or more embodiments, both the vacuum attachment 10, 10' and the manual brush 100 utilize a hook-and-loop textile fastener material in a novel manner to create unexpected and superior cleaning results, thereby allowing a user to finish a vacuuming job more quickly. The vacuum attachment 10, 10' described herein creates a more effective vacuum cleaning product for cleaning up and disposing of hair and fibrous debris in households and automobiles. Both the vacuum attachment 10, 10' and manual brush 100 are advantageous over conventional vacuum tools and manual brushes, thereby allowing homeowners to remove hair and fibrous debris more thoroughly and in a faster manner than conventional solutions, while maintaining a low cost.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A vacuum attachment for removing hair and/or fibrous debris from a crevice or surface being cleaned, the vacuum attachment comprising:

an attachment body portion, the attachment body portion having a first end and a second end, the first end of the attachment body portion being oppositely disposed relative to the second end of the attachment body portion, the first end of the attachment body portion configured to be connected to a vacuum hose, and the attachment body portion defining an air intake aperture at the second end of the attachment body portion; and an elongated rod disposed across a portion of the air intake aperture at the second end of the attachment body portion, the elongated rod having a first end and a second end, the first end of the elongated rod being oppositely disposed relative to the second end of the elongated rod, the elongated rod including a plurality of protruding elements projecting outwardly from the elongated rod, the plurality of protruding elements being disposed at least partially around a periphery of the elongated rod and along at least a portion of a length of the elongated rod between the first end and the second end, the elongated rod bisecting a central section of the air intake aperture so as to form a first air opening on a first side of the elongated rod that is unobstructed by the plurality of protruding elements and a second air opening on a second side of the elongated rod that is unobstructed by the plurality of protruding elements, the first side of the elongated rod being oppositely disposed relative to the second side of the elongated rod;

wherein the plurality of protruding elements of the elongated rod are configured to grab and collect the hair and/or fibrous debris from the crevice or surface being cleaned by the vacuum attachment.

2. The vacuum attachment according to claim 1, wherein the vacuum hose is fluidly coupled to a vacuum source configured to generate a suction force through the air intake aperture of the attachment body portion, and the vacuum attachment is configured to remove particulate debris from the crevice or surface being cleaned by means of the suction force, while simultaneously grabbing and collecting the hair and/or fibrous debris on the protruding elements of the elongated rod.

3. The vacuum attachment according to claim 1, wherein the attachment body portion comprises a first channel disposed on a first side of the attachment body portion and a second channel disposed on a second side of the attachment body portion, the first side being oppositely disposed relative to the second side; and wherein the elongated rod is arranged in a bent configuration across the portion of the air intake aperture of the attachment body portion, the first end of the elongated rod being received within the first channel on the first side of the attachment body portion, and the second end of the elongated rod being received within the second channel on the second side of the attachment body portion.

4. The vacuum attachment according to claim 3, wherein the bent configuration of the elongated rod is a substantially U-shaped configuration.

5. The vacuum attachment according to claim 3, wherein at least one of the first channel and the second channel comprises a plurality of staggered protrusions disposed therein, the plurality of staggered protrusions defining a passageway with staggered offset portions for securely retaining the elongated rod in place within the at least one of the first channel and the second channel of the attachment body portion.

6. The vacuum attachment according to claim 1, wherein the elongated rod is removably coupled to the attachment body portion so that the elongated rod is able to be replaced with a new elongated rod after being used to remove the hair and/or fibrous debris from the crevice or surface.

7. The vacuum attachment according to claim 1, wherein the elongated rod further comprises a central core portion and an outer covering bonded to the central core portion, the outer covering formed from a hook material strip, the hook material strip comprising the plurality of protruding elements of the elongated rod, and the hook material strip being made from a hook side of a hook-and-loop fastener material.

8. The vacuum attachment according to claim 7, wherein the central core portion is formed from a semi-flexible cable, the semi-flexible cable comprising a plurality of inner wires surrounded by an outer sheathing, the hook material strip being bonded to the outer sheathing of the semi-flexible cable.

9. The vacuum attachment according to claim 7, wherein the central core portion is formed from a plastic core.

10. The vacuum attachment according to claim 1, wherein the plurality of protruding elements of the elongated rod are in the form of a plurality of injection-molded micro-hook elements.

11. The vacuum attachment according to claim 1, wherein the vacuum attachment is in a form of a vacuum crevice tool for vacuuming particulate debris from a crack or crevice.

12. The vacuum attachment according to claim 1, further comprising at least one insert adapter configured to be inserted into the first end of the attachment body portion so as to enable the vacuum attachment to accommodate a vacuum hose size with a connection diameter that is different than an opening diameter at the first end of the attachment body portion.

13. The vacuum attachment according to claim 12, wherein the at least one insert adapter configured to be inserted into the first end of the attachment body portion comprises a plurality of insert adapters having different sizes so as to accommodate vacuum hose sizes with different connection diameters.

14. The vacuum attachment according to claim 1, further comprising at least one elastic sleeve member configured to operate as a spacer between a first end opening of the attachment body portion and a connection end portion of the vacuum hose so as to enable the vacuum attachment to accommodate a vacuum hose size with a connection diameter that is smaller than the first end opening of the attachment body portion.

15. The vacuum attachment according to claim 14, wherein the at least one elastic sleeve member comprises a plurality of elastic sleeve members that are useable together so as to accommodate vacuum hose sizes with different connection diameters.

16. The vacuum attachment according to claim 1, wherein an outer width of the elongated rod with the plurality of protruding elements is substantially less than a width of the air intake aperture of the attachment body portion.

17. A manual brush for removing hair and/or fibrous debris from a crevice or surface being cleaned, the manual brush comprising:

a handle portion, the handle portion having a first end and a second end, the first end of the handle portion being oppositely disposed relative to the second end of the handle portion, the first end of the handle portion configured to be grasped by a user;

an elongated rod attached to the second end of the handle portion, the elongated rod having a first end and a second end, the first end of the elongated rod being oppositely disposed relative to the second end of the elongated rod, the elongated rod including a first plurality of protruding elements projecting outwardly from the elongated rod, the first plurality of protruding elements being disposed at least partially around a periphery of the elongated rod and along at least a portion of a length of the elongated rod between the first end and the second end; and a brush holder having a first side and a second side, the first side of the brush holder being oppositely disposed relative to the second side of the brush holder, the handle portion of the manual brush configured to be removably coupled to the first side of the brush holder, and the second side of the brush holder comprising a cleaning section with a second plurality of protruding elements for cleaning the elongated rod of the manual brush;

wherein the first plurality of protruding elements of the elongated rod are configured to grab and collect the hair and/or fibrous debris from the crevice or surface being cleaned by the manual brush; and wherein the manual brush is a standalone cleaning device that does not attach to a vacuum cleaner.

18. The manual brush according to claim 17, wherein the handle portion comprises a first attachment member disposed on a first side of the handle portion and a second attachment member disposed on a second side of the handle portion, the first side being oppositely disposed relative to the second side; and wherein the elongated rod is arranged in a bent configuration on the second end of the handle portion, the first end of the elongated rod engaging with the first attachment member on the first side of the handle portion, and the second end of the elongated rod engaging with the second attachment member on the second side of the handle portion.

19. The manual brush according to claim 17, wherein the elongated rod is removably coupled to the handle portion so that the elongated rod is able to be replaced with a new elongated rod after being used to remove the hair and/or fibrous debris from the crevice or surface.

20. The manual brush according to claim 17, wherein the elongated rod further comprises a central core portion and an outer covering bonded to the central core portion, the outer covering formed from a hook material strip, the hook material strip comprising the first plurality of protruding elements of the elongated rod, and the hook material strip being made from a hook side of a hook-and-loop fastener material.

* * * * *